US009187837B2

(12) United States Patent
Kojima et al.

(10) Patent No.: US 9,187,837 B2
(45) Date of Patent: Nov. 17, 2015

(54) PLATING APPARATUS, NOZZLE-ANODE UNIT, METHOD OF MANUFACTURING PLATED MEMBER, AND FIXING APPARATUS FOR MEMBER TO BE PLATED

(71) Applicant: Yuken Industry Co., Ltd., Aichi (JP)

(72) Inventors: Norikazu Kojima, Aichi (JP); Yoshiharu Kikuchi, Aichi (JP)

(73) Assignee: Yuken Industry Co., Ltd., Aichi (JP)

( * ) Notice: Subject to any disclaimer, the term of this patent is extended or adjusted under 35 U.S.C. 154(b) by 0 days.

(21) Appl. No.: 14/155,175

(22) Filed: Jan. 14, 2014

(65) Prior Publication Data

US 2014/0190835 A1 Jul. 10, 2014

Related U.S. Application Data

(63) Continuation of application No. PCT/JP2013/062767, filed on May 2, 2013.

(30) Foreign Application Priority Data

Nov. 1, 2012 (JP) ..... 2012-241445

(51) Int. Cl.

| | |
|---|---|
| ***C25D 21/10*** | (2006.01) |
| ***C25D 5/04*** | (2006.01) |
| ***C25D 17/00*** | (2006.01) |
| ***C25D 21/12*** | (2006.01) |
| ***C25D 17/06*** | (2006.01) |
| ***C25D 17/10*** | (2006.01) |

(52) U.S. Cl.

CPC *C25D 5/04* (2013.01); *C25D 17/00* (2013.01); *C25D 17/06* (2013.01); *C25D 17/10* (2013.01); *C25D 21/10* (2013.01); *C25D 21/12* (2013.01)

(58) Field of Classification Search

CPC ..... C25D 21/12–21/14; C25D 5/04

See application file for complete search history.

(56) References Cited

U.S. PATENT DOCUMENTS

| | | | | |
|---|---|---|---|---|
| 5,108,552 | A * | 4/1992 | Desthomas | 205/82 |
| 6,344,123 | B1 * | 2/2002 | Bhatnagar | 205/96 |
| 2006/0081478 | A1 * | 4/2006 | Sahoda et al. | 205/148 |

FOREIGN PATENT DOCUMENTS

| | | | | |
|---|---|---|---|---|
| JP | H01306596 | A | 12/1989 | |
| JP | H2-74000 | * | 3/1990 | C25D 21/12 |

(Continued)

OTHER PUBLICATIONS

Eto Hideo, Abstract and Machine Translation, JP 2010-059449 (2010).*

(Continued)

*Primary Examiner* — James Lin
*Assistant Examiner* — Ho-Sung Chung
(74) *Attorney, Agent, or Firm* — Osha Liang LLP

(57) ABSTRACT

A plating apparatus includes a plating bath, an insoluble anode located in the plating bath, a plating electric power supply being capable of applying a voltage between the insoluble anode and the member to be plated, an anode-displacement mechanism being capable of moving the insoluble anode in the plating bath and of holding the insoluble anode at a predetermined position in the plating bath, and a controller having an anode-position controller being capable of generating a control signal for controlling an action of the anode-displacement mechanism and of outputting the control signal to the anode-displacement mechanism.

12 Claims, 18 Drawing Sheets

(56) References Cited

FOREIGN PATENT DOCUMENTS

| | | | | | |
|---|---|---|---|---|---|
| JP | H0336292 | A | | 2/1991 | |
| JP | 2000034597 | A | | 2/2000 | |
| JP | 2000256897 | A | | 9/2000 | |
| JP | 2003221700 | A | | 8/2003 | |
| JP | 2004300462 | A | | 10/2004 | |
| JP | 2005272999 | A | | 10/2005 | |
| JP | 2010-059449 | | * | 3/2010 | ..... C25D 5/02 |
| JP | 2010059449 | A | | 3/2010 | |

OTHER PUBLICATIONS

Shimamune et al., English Abstract, JP H2-74000 (1990).*
International Search Report for PCT/JP2013/062767 mailed Aug. 6, 2013 (3 pages).
IPDL (Industrial Property Digital Library) Abstract, Publication No. H03-36292 (1 Page).
IPDL (Industrial Property Digital Library) Abstract, Publication No. H01-306596 (1 Page).

* cited by examiner

PLATING APPARATUS, NOZZLE-ANODE UNIT, METHOD OF MANUFACTURING PLATED MEMBER, AND FIXING APPARATUS FOR MEMBER TO BE PLATED

TECHNICAL FIELD

The present invention relates to a plating apparatus, and specifically to a plating apparatus capable of performing high-speed and uniform plating, a nozzle-anode unit used for the plating apparatus, a method of manufacturing a plated member using the plating apparatus, and a fixing apparatus preferably used in the plating apparatus.

BACKGROUND ART

It is highly demanded to form a uniform thickness of plated film on various members, such as electronic/electric components, parts for transportations such as automobiles, and constructional members, so various approaches have been proposed to respond to such demand.

One of the proposed approaches is an in-line method in which plural members to be plated are continuously immersed in the plating solution (or may be subjected to a jet flow of the plating solution), and plating is performed while moving the members in the plating solution (or while moving the region subjected to the jet flow of the plating solution). According to this method, even though the period of time for plating one member to be plated tends to be long, a number of plated members, in which each plated film is formed on the surface to be plated of the member, can be obtained in a short period of time. This method may be suitable for a case where the total number of members to be plated is large such as standard products and the members have a simple shape (such as planar plate shape).

On the other hand, batch-type plating may also be selected such as due to a fewer number of members to be plated for the above in-line method. In such batch-type plating, as disclosed for example in Patent Literature 1 or 2 below, a member to be plated may be rotated in the plating bath thereby equalizing the flow of plating solution supplied to the member and thus enhancing the uniformity of the thickness of the plated film.

PRIOR ART LITERATURE

Patent Literature

Patent Literature 1; JP 2000-256897 A
Patent Literature 2: JP 2004-300462 A

DISCLOSURE OF THE INVENTION

Problems to be Solved by the Invention

In Patent Literature 1 or 2, however, it is assumed that a member to be plated is basically in a planar plate shape or sufficiently small relative to a holding mechanism for the member rotating to be plated, so any means has not been provided to perform electroplating at a high speed while enhancing the uniformity of the thickness of the plated film for members to be plated having a complex shape, such as engine blocks and pressed components.

Considering such technical background, problems to be solved by the present invention include providing a plating apparatus that performs electroplating uniformly and at a high-speed regardless of the shape of a member to be plated. In addition, problems to be solved by the present invention include providing a nozzle-anode unit used in such a high-speed plating apparatus. Moreover, problems to be solved by the present invention include providing a plated member produced by the plating apparatus. Furthermore, problems to be solved by the present invention include providing a fixing apparatus for a member to be plated preferably used in the plating apparatus.

Means for Solving the Problems

The present invention provided for solving the above problems is as follows:

(1) A plating apparatus comprising: a plating bath; an insoluble anode located in the plating bath; a plating electric power supply being capable of applying a voltage between the insoluble anode and a member to be plated; an anode-displacement mechanism being capable of moving the insoluble anode in the plating bath and of holding the insoluble anode at a predetermined position in the plating bath; and a controller having an anode-position controller being capable of generating a control signal for controlling an action of the anode-displacement mechanism and of outputting the control signal to the anode-displacement mechanism.

(2) The plating apparatus according to the above (1) comprising a measurement instrument being capable of measuring at least one of a current flowing through the insoluble anode and an electric potential of the insoluble anode with respect to the member to be plated while a voltage is applied from the plating electric power supply.

(3) The plating apparatus according to the above (2), wherein the controller comprises an electric-output controller being capable of generating a control signal for controlling at least one of a current and a voltage applied to the insoluble anode based on a result measured by the measurement instrument and of outputting the control signal to the plating electric power supply.

(4) The plating apparatus according to the above (2) or (3), wherein the anode-position controller is capable of generating a control signal for controlling an action of the anode-displacement mechanism based on a result measured by the measurement instrument and of outputting the control signal to the anode-displacement mechanism.

(5) The plating apparatus according to any one of the above (1) to (4), the apparatus further comprising: a circulation mechanism for circulating a plating solution in the plating bath, the circulation mechanism having a plating solution-suctioning portion, a pump, and a plating solution-ejecting portion; a circulation controller contained in the controller, the circulation controller being capable of generating a control signal for controlling an action of the circulation mechanism and of outputting the control signal to the circulation mechanism; an ejecting portion-displacement mechanism being capable of moving the ejecting portion in the plating bath and of holding the ejecting portion at a predetermined position in the plating bath; and an ejecting portion-position controller contained in the controller, the ejecting portion-position controller being capable of generating a control signal for controlling an action of the ejecting portion-displacement mechanism and of outputting the control signal to the ejecting portion-displacement mechanism.

(6) The plating apparatus according to the above (5), wherein the circulation mechanism has an ejecting-volume adjusting mechanism being capable of adjusting a plating solution ejecting-volume ejected from the plating solution-ejecting portion, and the circulation controller comprises an ejecting-volume controller being capable of generating a control signal for controlling an action of the ejecting-volume adjusting mechanism and of outputting the control signal to the ejecting-volume adjusting mechanism.

(7) The plating apparatus according to any one of the above (2) to (4), the apparatus further comprising: a circulation mechanism for circulating a plating solution in the plating bath, the circulation mechanism having a plating solution-suctioning portion, a pump, and a plating solution-ejecting portion; a circulation controller contained in the controller, the circulation controller being capable of generating a control signal for controlling an action of the circulation mechanism and of outputting the control signal to the circulation mechanism; an ejecting portion-displacement mechanism being capable of moving the ejecting portion in the plating bath and of holding the ejecting portion at a predetermined position in the plating bath; and an ejecting portion-position controller contained in the controller, the ejecting portion-position controller being capable of generating a control signal for controlling an action of the ejecting portion-displacement mechanism and of outputting the control signal to the ejecting portion-displacement mechanism, wherein the ejecting portion-position controller is capable of generating the control signal for controlling an action of the ejecting portion-displacement mechanism based on a result measured by the measurement instrument.

(8) The plating apparatus according to the above (7), wherein the circulation mechanism has an ejecting-volume adjusting mechanism being capable of adjusting a plating solution ejecting-volume ejected from the plating solution-ejecting portion, and the circulation controller comprises an ejecting-volume controller being capable of generating a control signal for controlling an action of the ejecting-volume adjusting mechanism based on a result measured by the measurement instrument and of outputting the control signal to the ejecting-volume adjusting mechanism.

(9) The plating apparatus according to any one of the above (1) to (8), the apparatus further comprising: a member-displacement mechanism being capable of moving the member to be plated and of holding the member to be plated at a position in which at least a part of the member to be plated is located in the plating bath; and a member-position controller contained in the controller, the member-position controller being capable of generating a control signal for controlling an action of the member-displacement mechanism and of outputting the control signal to the member-displacement mechanism.

(10) The plating apparatus according to the above (9), wherein the member-position controller is capable of outputting the control signal for controlling an action of the member-displacement mechanism while a voltage is applied between the insoluble anode and the member to be plated from the plating electric power supply.

(11) The plating apparatus according to any one of the above (5) to (10), wherein the insoluble anode is such that its relative position to the plating solution-ejecting portion is managed, at least a part of the insoluble anode is located at a position from which an ejecting hole of the plating solution-ejecting portion is in view, the ejecting portion-displacement mechanism and the anode-displacement mechanism are integrated, and the ejecting portion-position controller and the anode-position controller are integrated.

(12) The plating apparatus according to the above (11), wherein the insoluble anode is such that the part of the insoluble anode located at the position from which the ejecting hole of the plating solution-ejecting portion is in view has a shape of a guide being capable of guiding a plating solution ejected from the plating solution-ejecting portion to a predetermined direction.

(13) The plating apparatus according to the above (11) or (12), wherein the insoluble anode is such that the part of the insoluble anode located at the position from which the ejecting hole of the plating solution-ejecting portion is in view has a shape of a structure formed of a planar member having a through-hole or a structure obtained by fabricating a planar member.

(14) The plating apparatus according to any one of the above (9) to (13), wherein, upon a condition that the member-position controller has driven the member-displacement mechanism so that at least a part of the member to be plated is immersed in a plating solution, at least one of plural position controllers included in the controller drives at least one of displacement mechanisms, which is other than the member-displacement mechanism and is controlled by the at least one position controller, so that a component that is capable of moving in the plating bath by the at least one displacement mechanism moves in a direction proximal to the member to be plated.

(15) The plating apparatus according to the above (14), wherein, upon a condition that at least one of plural position controllers included in the controller has driven at least one of displacement mechanisms, which is other than the member-displacement mechanism and is controlled by the at least one position controller, so that a component that is capable of moving in the plating bath by the at least one displacement mechanism moves in a direction distal from the member to be plated, the member-position controller drives the member-displacement mechanism so that the member to be plated is taken out of the plating solution.

(16) A method of manufacturing a plated member, comprising: a member-positioning step of immersing at least a part of a member to be plated in a plating solution in a plating bath; an anode-positioning step of moving an insoluble anode located in the plating bath so as to be more proximal to the member to be plated in the plating solution and of holding the insoluble anode at a first position; an applying step of applying a voltage between the insoluble anode and the member to be plated to form a plated film on the member; an anode-evacuating step of moving the insoluble anode so as to be more distal from the member formed thereon with the plated film and of holding the insoluble anode at a second position; and a member-recovering step of taking the member formed thereon with the plated film out of the plating solution to obtain the member as the plated member.

(17) The method according to the above (16), wherein the anode-positioning step starts before the member-positioning step has finished.

(18) The method according to the above (16) or (17), wherein the member-recovering step starts before the anode-evacuating step has finished.

(19) The method according to any one of the above (16) to (18), wherein the first position is a position at which the member to be plated interferes with the insoluble anode when the member is moved so that the member is taken out of the plating solution, and the second position is a position at which the member to be plated does not interfere with the insoluble anode when the member is moved so that the member is taken out of the plating solution.

(20) The method according to any one of the above (16) to (19), wherein at least one of a position of the member to be plated in the plating bath and a position of the insoluble anode in the plating bath is changed during the applying step.

(21) The method according to the above (20), wherein the position of the member to be plated in the plating bath and the position of the insoluble anode in the plating bath are changed while the relative positional relationship between the member to be plated and the insoluble anode is managed.

(22) The method according to any one of the above (16) to (21), wherein at least the applying step is carried out while the plating solution in the plating bath is circulated by a circulation mechanism comprising a plating solution-suctioning portion, a pump, and a plating solution-ejecting portion, and wherein the method further comprises: an ejecting portion-positioning step of moving the plating solution-ejecting portion located in the plating bath so as to be more proximal to the member to be plated in the plating solution and of holding the plating solution-ejecting portion at a third position, the step being started in a period from the beginning of the member-positioning step to the end of the applying step; and an ejecting portion-evacuating step of moving the plating solution-ejecting portion so as to be more distal from the member formed thereon with the plated film and of holding the plating solution-ejecting portion at a fourth position, the ejecting portion-evacuating step being started in a period from the beginning of the applying step to the end of the member-recovering step.

(23) The method according to the above (22), wherein the third position is a position at which the member to be plated interferes with at least one of the insoluble anode and the plating solution-ejecting portion when the member is moved so that the member is taken out of the plating solution, and the fourth position is a position at which the member to be plated does not interfere with any of the insoluble anode and the plating solution-ejecting portion when the member is moved so that the member is taken out of the plating solution.

(24) The method according to the above (22) or (23), wherein at least one of a location of the member to be plated in the plating bath, a location of the insoluble anode in the plating bath, a location of the plating solution-ejecting portion in the plating bath, and a plating solution volume ejected from the plating solution-ejecting portion is changed during the applying step.

(25) The method according to the above (24), wherein the location of the member to be plated in the plating bath, the location of the insoluble anode in the plating bath, the location of the plating solution-ejecting portion in the plating bath are changed while the relative positional relationship among the member to be plated, the insoluble anode, and the plating solution-ejecting portion is managed.

(26) The method according to any one of the above (22) to (25), wherein the insoluble anode is such that its relative position to the plating solution-ejecting portion is managed, at least a part of the insoluble anode is located at a position from which an ejecting hole of the plating solution-ejecting portion is in view, the anode-positioning step and the ejecting portion-positioning step are integrated, and the anode-evacuating step and the ejecting portion-evacuating step are also integrated.

(27) A nozzle-anode unit comprising a plating solution-ejecting portion and an insoluble anode, the plating solution-ejecting portion being located in a plating bath for returning a plating solution in the plating bath, suctioned from a plating solution-suctioning portion, back to the plating bath using circulation by a pump, at least a part of the insoluble anode being located at a position from which an ejecting hole of the plating solution-ejecting portion is in view, the insoluble anode being such that its relative position to the ejecting hole is managed.

(28) The nozzle-anode unit according to the above (27), wherein the insoluble anode is such that the part of the insoluble anode located at the position from which the ejecting hole of the plating solution-ejecting portion is in view comprises a planar member having a through-hole or has a shape of a structure obtained by fabricating the planar member.

(29) The nozzle-anode unit according to the above (27) or (28), wherein the insoluble anode is such that the part of the insoluble anode located at the position from which the ejecting hole of the plating solution-ejecting portion is in view has a shape of a guide being capable of guiding a plating solution ejected from the plating solution-ejecting portion to a predetermined direction.

(30) The nozzle-anode unit according to the above (28) or (29), wherein the insoluble anode has a portion comprised of a tubular body having a first end, the first end being one end of the tubular body and located at the position from which the ejecting hole of the plating solution-ejecting portion is in view, and wherein the plating solution ejected from the ejecting hole of the plating solution-ejecting portion is supplied into a plating bath through the inside of the portion comprised of the tubular body.

(31) The nozzle-anode unit according to the above (30), wherein a second end, which is the opposite end to the first end of the portion comprised of the tubular body, is covered up with a planar member having an inscribed circle of a diameter larger than that of a circumscribed circle of an aperture at the second end; and wherein the plating solution-ejecting portion has a through-hole, one aperture of the through-hole is the ejecting hole for the plating solution, and the portion comprised of the tubular body is set inside from the other aperture-side of the through-hole so that the first end is located at the position from which the ejecting hole for the plating solution is in view.

(32) A fixing apparatus for fixing a member to be plated comprising two hollow portions, each of the two hollow portions having at least one aperture, the fixing apparatus comprising: a first rod-shaped body, one end of the first rod-shaped body being capable of being inserted into one of the two hollow portions from the aperture thereof; a second rod-shaped body, one end of the second rod-shaped body being capable of being inserted into the other of the two hollow portions from the aperture thereof; and a rod-shaped body-movably holding mechanism, wherein the rod-shaped body-movably holding mechanism allows the other ends of the first rod-shaped body and the second rod-shaped body to move both closer to each other and apart from each other and to be held in a condition of being biased to directions that the other ends are closer to each other and in a condition of being biased to directions that the other ends are apart from each other, so that the first rod-shaped body contacts with pressure at least two positions inside the one hollow portion and the second rod-shaped body contacts with pressure at least two positions inside the other hollow portion, and thereby the member to be plated is held by the first rod-shaped body and the second rod-shaped body.

(33) The fixing apparatus according to the above (32), wherein contact portions of at least one of the first rod-shaped body and the second rod-shaped body with the hollow portion of the member to be plated are electrical contacts to the member to be plated.

(34) The fixing apparatus according to the above (32) or (33) comprising a rod-shape member-driving mechanism having a driving mechanism being capable of moving the other ends of the first rod-shaped body and the second rod-shaped body both closer to each other and apart from each other, and of holding the other ends of the first rod-shaped body and the second rod-shaped body in a condition of being biased to directions that the other ends have been moved.

Advantageous Effect of the Invention

According to the present invention above, not only in the case where a member to be plated has a planar plate shape but also in the case where a member to be plated has a complex three-dimensional shape, electroplating is performed in a state of the insoluble anode and/or the plating solution-ejecting portion being located at positions depending on the shape of the member to be plated, and the electroplating can thereby be performed at a high speed while enhancing the uniformity of the thickness of plated film formed on the member. In particular, by using the nozzle-anode unit of the present invention, a plated film of sufficient thickness can be formed at a high speed on a part which was harder to be plated than the other by conventional technologies. Moreover, using the fixing apparatus for a member to be plated of the present invention allows the member to easily be detachably attached, and in one embodiment, a large current can be applied to the member to be plated.

BEST MODES FOR CARRYING OUT THE INVENTION

Embodiments of the present invention will hereinafter be described with reference to the drawings.

Figure 1:
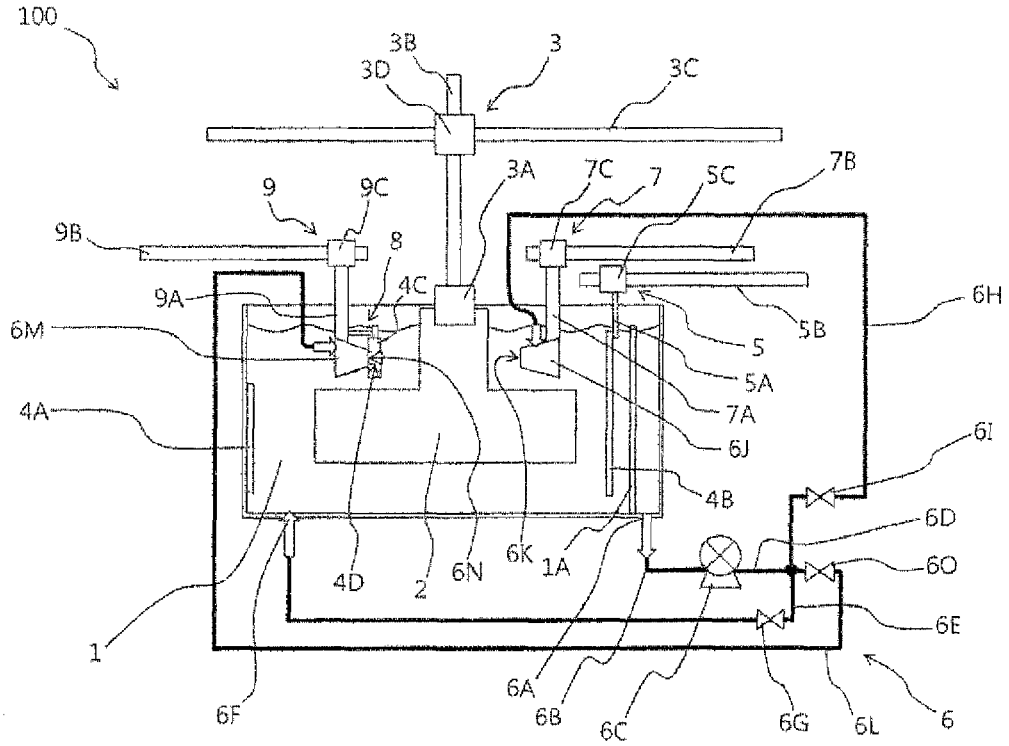
FIG. 1 is a view conceptually illustrating the configuration of a plating apparatus according to one embodiment of the present invention.

FIG. 1 is a view conceptually illustrating the configuration of a plating apparatus according to one embodiment of the present invention. FIG. 1 omits the indication of features relevant to electricity, such as a plating electric power supply, electric wirings for applying voltages to a member to be plated and an anode, and control wirings, among which features relevant to control of the plating apparatus will be described with reference to FIG. 2.

Plating apparatus 100 according to the present embodiment is provided with a plating bath 1 which stores a plating solution therein. Member 2 to be plated is in a state of being immersed in the plating solution, and the member 2 is held by a member-displacement mechanism 3.

The member-displacement mechanism 3 performs the movement of the member 2 to be plated and the hold of the member 2 at a position where at least a part of the member 2 is located in the plating bath 1, and is controlled by a member-position controller as will be described later. The member-displacement mechanism 3 comprises: a fixing device 3A which directly contacts with the member 2 to be plated and holds it; a vertical direction linear movement sliding axis 3B which guides the fixing device 3A to move up and down and of which the lower end or its vicinity in the vertical direction in FIG. 1 is provided with the fixing apparatus 3A; a horizontal direction linear movement sliding axis 3C which guides the fixing device 3A to move in the horizontal direction; and a sliding and holding device 3D which moves on the vertical direction linear movement sliding axis 3B and on the horizontal direction linear movement sliding axis 3C thereby to vary the position of the member 2 to be plated and which maintains a state of staying at a predetermined position on the vertical direction linear movement sliding axis 3B and on the horizontal direction linear movement sliding axis 3C thereby to hold the member 2 at a predetermined position.

Some members as a part of the fixing device 3A also act as current-carrying components to the member 2 to be plated. Specific configuration of the fixing device 3A and the operation thereof will be described later. Specific configuration of the vertical direction linear movement sliding axis 3B and the horizontal direction linear movement sliding axis 3C is not particularly limited. They may be appropriately selected from commercially available ones as so-called linear-guides, in which the distance the sliding and holding device 3D can be driven and the withstand load may be adapted to the utilization purpose. Specific configuration of the sliding and holding device 3D is also not particularly limited. So long as being capable of appropriately controlling the position of the member 2 to be plated, method of driving and holding the member 2 may be pneumatic-type, hydraulic-type, electric-type, or other appropriate type.

The plating apparatus 100 according to the present embodiment is provided with a plurality of insoluble anodes in the plating bath 1. More specifically, the plurality of insoluble anodes comprises: one or more fixed insoluble anodes (referred also to as "fixed anode(s)", hereinafter) 4A provided on a side-wall of the plating bath 1; one or more movable insoluble anodes (referred also to as "movable anode(s)", hereinafter) 4B of which each position can be varied by an anode-displacement mechanism 5; and one or more insoluble anodes (referred also to as "NAU anode(s)", hereinafter) 4C each of which is a component of a nozzle-anode unit (details will be described later, referred also to as "NAU", hereinafter). Material for the insoluble anodes is not particularly limited. Commonly used material may be employed, and specific examples thereof include titanium material plated with platinum.

The anode-displacement mechanism 5 is to move the movable anode 4B in the plating bath 1 and to hold the movable anode 4B at a predetermined position in the plating bath 1, and is controlled by an anode-position controller as will be described later. The basic configuration of the anode-displacement mechanism 5 is like that of the member-displacement mechanism 3, and is configured of a vertical direction linear movement sliding axis 5A, a horizontal direction linear movement sliding axis 5B, and a sliding and holding device 50.

The vertical direction linear movement sliding axis 5A is to be a guide when moving the movable anode 4B up and down, and in FIG. 1 the movable anode 4B is provided at the lower end thereof in the vertical direction or its vicinity. The horizontal direction linear movement sliding axis 5B is to guide the horizontal movement of the movable anode 4B. The sliding and holding device 5C moves on the vertical direction linear movement sliding axis 5A and on the horizontal direction linear movement sliding axis 5B thereby to vary the position of the movable anode 4B, and maintains a state of staying at a predetermined position on the vertical direction linear movement sliding axis 5A and on the horizontal direction linear movement sliding axis 5B thereby to hold the movable anode 4B at a predetermined position.

Specific configuration of the vertical direction linear movement sliding axis 5A and the horizontal direction linear movement sliding axis 5B is not particularly limited. They may be appropriately selected from commercially available ones as so-called linear-guides, in which the distance the sliding and holding device 5C can be driven and the withstand load may be adapted to the utilization purpose. Specific configuration of the sliding and holding device 5C is also not particularly limited. So long as being capable of appropriately controlling the position of the movable anode 4B, method of driving and holding the movable anode 4B may be pneumatic-type, hydraulic-type, electric-type, or other appropriate type. As will be described later, the movable anode 4B may be coordinated with the member 2 to be plated while being managed the relative position thereto, in which case it is preferred that the member-displacement mechanism 3 and the anode-displacement mechanism 5 are driven in the same manner.

The plating apparatus 100 according to the present embodiment has a circulation mechanism 6 for circulating the plating solution in the plating bath 1. The circulation mechanism 6 in the plating apparatus 100 according to the present embodiment comprises: a plating solution-suctioning portion 6A; an outward pipe 6B; a pump 6C; a return pipe 6D; a first return pipe 6E; a fixed plating solution-ejecting portion 6F; a first flow volume adjusting valve 6G; a second return pipe 6H; a second flow volume adjusting valve 6I; a movable plating solution-ejecting portion 6J; an ejecting hole 6K thereof; a third return pipe 6L; a plating solution-ejecting portion (referred to as "NAU ejecting portion", hereinafter) 6M of the nozzle-anode unit (NAU), an ejecting hole 6N thereof, and a third flow volume adjusting valve 6O.

The plating solution-suctioning portion 6A is provided at a bottom part of a region partitioned by a partition plate 1A for overflowing in the plating bath 1 (this region will be referred to as "suctioning region" while a region other than the suctioning region will be referred to as "main region", hereinafter), and is to suction the plating solution in the plating bath 1. The plating solution suctioned from the plating solution-suctioning portion 6A reaches the pump 6C via the outward pipe 6B. The return pipe 6D, through which the plating solution pumped out by the pump 6C flows, is branched into the first return pipe 6E, the second return pipe 6H, and the third return pipe 6L.

One end of the first return pipe 6E is connected to the fixed plating solution-ejecting portion 6F provided at the bottom part of the main region of the plating bath 1. This allows the circulation mechanism 6 to configure a circulation system (referred also to as "first circulation system", hereinafter) which suctions the plating solution, overflowed from the main region to the suctioning region, from the plating solution-suctioning portion 6A and pressurizes the plating solution using the pump 6C to return it to the main region via the fixed plating solution-ejecting portion 6F. The plating solution volume flowing in this first circulation system may be adjusted by the pump 6C and the first flow volume adjusting valve 6G provided in the middle of the first return pipe 6E.

One end of the second return pipe 6H is connected to the movable plating solution-ejecting portion 6J located in the plating bath 1. This allows the circulation mechanism 6 to configure a circulation system (referred also to as "second circulation system", hereinafter) which suctions the plating solution, overflowed from the main region to the suctioning region, from the plating solution-suctioning portion 6A and pressurizes the plating solution using the pump 6C to return it to the main region via the ejecting hole 6K of the movable plating solution-ejecting portion 6J. The plating solution volume flowing in this second circulation system may be adjusted by the pump 6C and the second flow volume adjusting valve 6I provided in the middle of the second return pipe 6H.

The movable plating solution-ejecting portion 6J is configured such that its location in the plating bath 1 can be varied by an ejecting portion-displacement mechanism 7 which comprises a vertical direction linear movement sliding axis 7A, a horizontal direction linear movement sliding axis 7B, and a sliding and holding device 7C. The vertical direction linear movement sliding axis 7A is to be a guide when moving the movable plating solution-ejecting portion 6J up and down, and in FIG. 1 the movable plating solution-ejecting portion 6J is provided at the lower end thereof in the vertical direction or its vicinity. The horizontal direction linear movement sliding axis 7B is to guide the horizontal movement of the movable plating solution-ejecting portion 6J. The sliding and holding device 7C moves on the vertical direction linear movement sliding axis 7A and on the horizontal direction linear movement sliding axis 7B thereby to vary the position of the movable plating solution-ejecting portion 6J, and maintains a state of staying at a predetermined position on the vertical direction linear movement sliding axis 7A and on the horizontal direction linear movement sliding axis 7B thereby to hold the movable plating solution-ejecting portion 6J at a predetermined position.

Specific configuration of the vertical direction linear movement sliding axis 7A and the horizontal direction linear movement sliding axis 7B is not particularly limited. They may be appropriately selected from commercially available ones as so-called linear-guides, in which the distance the sliding and holding device 7C can be driven and the withstand load may be adapted to the utilization purpose. Specific configuration of the sliding and holding device 7C is also not particularly limited. So long as being capable of appropriately controlling the position of the movable plating solution-ejecting portion 6J, method of driving and holding the sliding and holding device 7C may be pneumatic-type, hydraulic-type, electric-type, or other appropriate type. As will be described later, the movable plating solution-ejecting portion 6J may be coordinated with the movable anode 4B and/or the member 2 to be plated while being managed the relative position thereto, in which case it is preferred that the ejecting portion-displacement mechanism 7 is driven in the same manner as those for the member-displacement mechanism 3 and/or the anode-displacement mechanism 5.

One end of the third return pipe 6L is connected to the plating solution-ejecting portion (NAU ejecting portion) 6M of a nozzle-anode unit (NAU) 8 located in the plating bath 1. This allows the circulation mechanism 6 to configure a circulation system (referred also to as "third circulation system", hereinafter) which suctions the plating solution, overflowed from the main region to the suctioning region, from the plating solution-suctioning portion 6A and pressurizes the plating solution using the pump 6C to return it to the main region via the ejecting hole 6N of the NAU ejecting portion 6M. The plating solution volume flowing in this third circulation system may be adjusted by the pump 6C and the third flow volume adjusting valve 6O provided in the middle of the third return pipe 6L.

The nozzle-anode unit (NAU) 8 comprises: the NAU ejecting portion 6M; and an NAU anode 4C of which the relative position to the NAU ejecting portion 6M is managed (specific examples of the management include being fixed thereto) and which is configured such that at least a part thereof is located at a position from which the ejecting hole 6N of the NAU ejecting portion 6M is in view, i.e. a position facing the ejecting hole 6N. In FIG. 1, the NAU anode 4C is located so as to contact with the ejecting hole 6N, and one or more through-holes 4D of the NAU anode 4C are in communication with the ejecting hole 6N. Such a location allows the plating solution ejected from the ejecting hole 6N to diffuse into the plating bath 1 while at least a part of the plating solution contacts with the NAU anode 4C. Therefore, when a positive voltage is applied to the NAU anode 4C, the flow directions of the plating solution ejected from the through-holes 4D of the NAU anode 4C are likely to be parallel to the directions of lines of electric force, so that the deposition state of plating metal is also likely to be uniform in the surface to be plated of the member 2. The relative positions of the NAU anode 4C and the NAU ejecting portion 6M may be managed so as to be capable of being varied by means of some displacement mechanism.

The NAU 8 is configured such that its location in the plating bath 1 can be varied by an NAU-displacement mechanism 9 which comprises a vertical direction linear movement sliding axis 9A, a horizontal direction linear movement sliding axis 9B, and a sliding and holding device 9C. The NAU-displacement mechanism 9 can be considered as being a mechanism in which an anode-displacement mechanism and an ejecting portion-displacement mechanism are integrated. The vertical direction linear movement sliding axis 9A is to be a guide when moving the NAU 8 up and down, and in FIG. 1 the NAU 8 is provided at the lower end thereof in the vertical direction or its vicinity. The horizontal direction linear movement sliding axis 9B is to guide the horizontal movement of the NAU 8. The sliding and holding device 9C moves on the vertical direction linear movement sliding axis 9A and on the horizontal direction linear movement sliding axis 9B thereby to vary the position of the NAU 8, and maintains a state of staying at a predetermined position on the vertical direction linear movement sliding axis 9A and on the horizontal direction linear movement sliding axis 9B thereby to hold the NAU 8 at a predetermined position.

Specific configuration of the vertical direction linear movement sliding axis 9A and the horizontal direction linear movement sliding axis 9B is not particularly limited. They may be appropriately selected from commercially available ones as so-called linear-guides, in which the distance the sliding and holding device 9C can be driven and the withstand load may be adapted to the utilization purpose. Specific configuration of the sliding and holding device 9C is also not particularly limited. So long as being capable of appropriately controlling the position of the NAU 8, method of driving and holding the sliding and holding device 9C may be pneumatic-type, hydraulic-type, electric-type, or other appropriate type. As will be described later, the NAU 8 may be coordinated with the movable plating solution-ejecting portion 6J, the movable anode 4B, and/or the member 2 to be plated while being managed the relative position thereto, in which case it is preferred that the NAU-displacement mechanism 9 is driven in the same manner as those for the ejecting portion-displacement mechanism 7, the member-displacement mechanism 3, and/or the anode-displacement mechanism 5.

The circulation mechanism 6 in the plating apparatus 100 according to the present embodiment is provided with the single pump 6C as a device for circulating the plating solution, and the circulation mechanism 6 may also be provided with plural pumps. The arrangement of pumps in this case is not limited. Examples thereof include a configuration in which the first circulation system, the second circulation system, and the third circulation system are provided with respective pumps, which are controlled to be coordinated with one another.

That the insoluble anode included in the plating apparatus 100 according to the present embodiment (specifically at least one of the fixed anode 4A, the movable anode 4B, and the NAU anode 4C) may be provided with one or more insulating protection members at the side proximal to the member 2 to be plated for the purpose of reducing the possibility that the anode contacts with the member 2 to cause short-circuiting. Specific configuration of the protection members is not limited. Specific examples thereof include a configuration in which a mesh formed of plastic or the like is provided at the side of the insoluble anode proximal to the member 2 to be plated.

Figure 2:
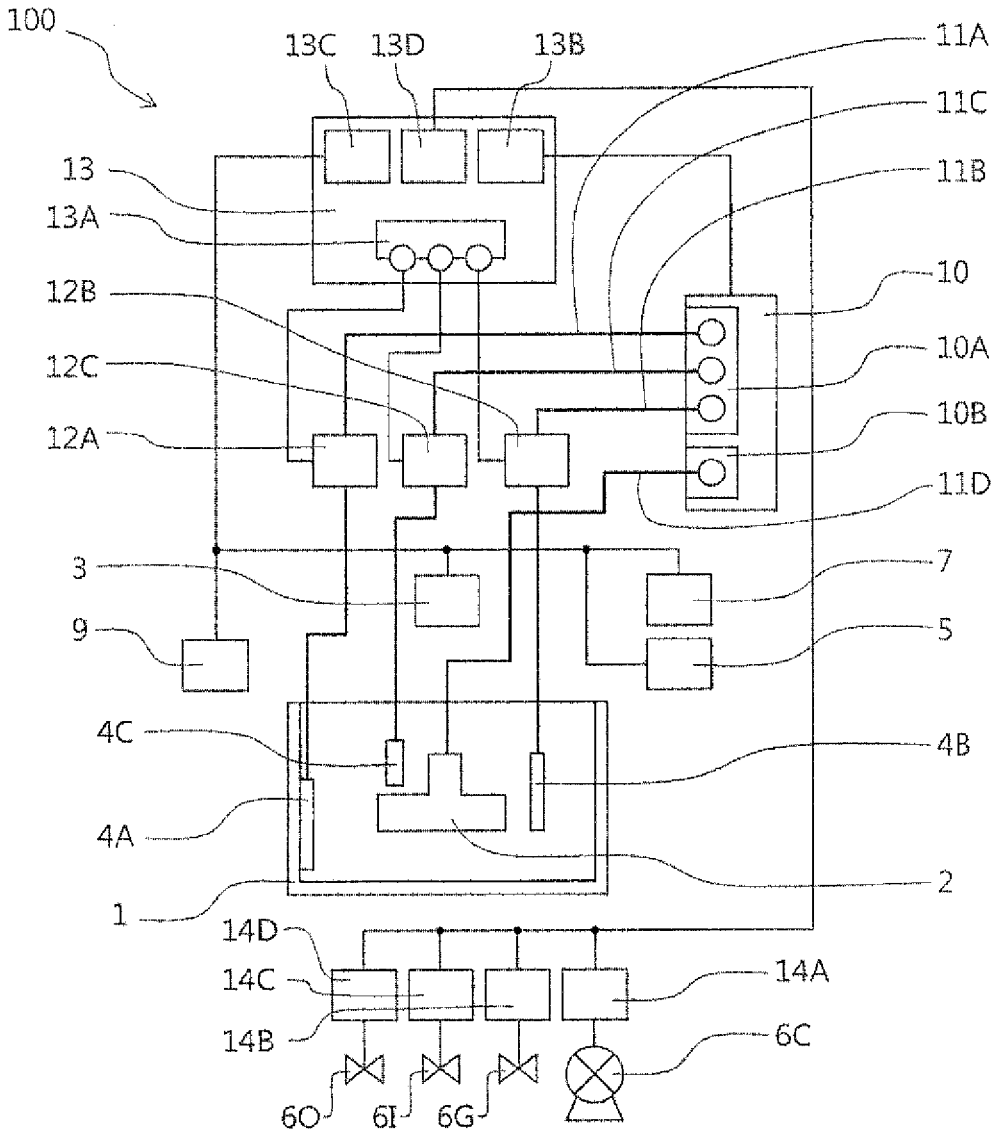
FIG. 2 is a block diagram conceptually illustrating the control in the plating apparatus according to one embodiment of the present invention.

FIG. 2 is a block diagram conceptually illustrating the control in the plating apparatus according to one embodiment of the present invention.

The fixed anode 4A, the movable anode 4B, and the NAU anode 4C located in the plating bath 1 are electrically connected to anode terminals 10A of a plating electric power supply 10 by way of a wiring 11A for the fixed anode 4A, a wiring 11B for the movable anode 4B, and a wiring 11C for the NAU anode 4C, respectively. In addition, the plating electric power supply 10 of the plating apparatus 100 shown in FIG. 1 is configured such that the voltage and current output from the wiring 11A for the fixed anode 4A, the voltage and current output from the wiring 11B for the movable anode 4B, and the voltage and current output from the wiring 11C for the NAU anode 4C can be controlled independently. Further, the member 2 to be plated located in the plating bath 1 is electrically connected to a cathode terminal 10B of the plating electric power supply 10 by way of a wiring 11D for the member to be plated.

The plating apparatus 100 according to the present embodiment is provided with measurement instruments 12A, 12B, 12C that measure at least ones of respective currents flowing through the fixed anode 4A, the movable anode 4B, and the NAU anode 4C (referred collectively to as "insoluble anodes 4A-4C") and respective electric potentials of the insoluble anodes 4A-4C to the member 2 to be plated. Specific configurations of the measurement instruments are not particularly limited. They may be ammeters, combination of shunt resistors and voltmeters, voltmeters, or combination thereof. FIG. 2 illustrates a configuration in which measurement instruments comprised of ammeters or measurement instruments comprised of shunt resistors and voltmeters are provided for the wiring 11A for the fixed anode 4A, the wiring 11B for the movable anode 4B, and the wiring 11C for the NAU anode 4C. One specific example in the case of measuring respective electric potentials of the insoluble anodes 4A-4C to the member 2 to be plated is such that the insoluble anodes 4A-4C are connected in parallel to the cathode terminal 10B of the plating electric power supply 10 by way of respective wirings each provided with a voltmeter, and each electric potential of the insoluble anodes 4A-4C to the member 2 can thus be individually measured by the voltmeter.

The plating apparatus 100 according to the present embodiment has a controller 13 to which signals as results obtained by the measurement instruments 12A, 12B, 12C are input and which generates a control signal for controlling the action of each device included in the plating apparatus 100 (such as the plating electric power supply 10, the sliding and holding device 3D, and the pump 6C) and outputs the control signal to the corresponding device. The controller 13 comprises a signal input unit 13A for receiving signals from the measurement instruments 12A, 12B, 12C, and an electric-output controller 13B, a position controller 13C, and a circulation controller 13D that are supplied thereto with the received signals by the signal input unit 13A. Plural controllers included in this controller 13 may be independent, or one controller may be able to function as plural controllers. This controller 13 also has a function to generate a control signal for controlling each device on the basis of a predefined control program and/or the input signal such as from a keyboard and an interface device and to output the control signal to the corresponding device.

The electric-output controller 13B uses the measured results from the measurement instruments 12A, 12B, 12C as the basis to generate control signals for controlling at least ones of the currents and the voltages to be applied to the insoluble anodes 4A-4C, and output these control signals to the plating electric power supply 10. The plating electric power supply 10, upon the condition that the control signals from the electric-output controller 13B have been input thereto, performs each action preliminarily associated with the corresponding input signal (increasing or decreasing of the output current or increasing or decreasing of the output voltage). In addition, the electric-output controller 13B also has a function to generate a control signal for controlling the plating electric power supply 10 on the basis of a predefined program and/or the input signal from a user interface device and to output the control signal to the plating electric power supply 10.

The position controller 13C comprises: a member-position controller which generates a control signal for controlling the action (such as movement and holding, here and hereinafter) of the sliding and holding device 3D of the member-displacement mechanism 3 and outputs the control signal to the sliding and holding device 3D; an anode-position controller which generates a control signal for controlling the action of the sliding and holding device 5C of the anode-displacement mechanism 5 and outputs the control signal to the sliding and holding device 5C; an ejecting portion-position controller which generates a control signal for controlling the action of the sliding and holding device 7C of the ejecting portion-displacement mechanism 7 and outputs the control signal to the sliding and holding device 7C; an NAU-position controller which generates a control signal for controlling the action of the sliding and holding device 9C of the NAU-displacement mechanism 9 and outputs the control signal to the sliding and holding device 9C; and a fixing device controller which generate a control signal for controlling the action of a driver to operate the fixing device 3A and outputs the control signal to the driver. The NAU-position controller can be considered as being a controller in which an anode-position controller for controlling the location of the NAU anode 4C in the plating bath 1 and an ejecting portion-position controller for controlling the location of the NAU ejecting portion 6M in the plating bath 1 are integrated.

The position controller 13C can generate control signals for the above plural position controllers on the basis of the measured results by the measurement instruments 12A, 12B, 12C. In addition, the position controller 13C can use a predefined control program and/or an input signal from an interface device as the basis to generate control signals for the above plural position controllers.

The position controller 13C can individually generate control signals for the above plural controllers included therein. Moreover, the position controller 13C can also cause plural controllers to cooperate with one another in order for plural sliding and holding devices to be coordinated. In a specific example of such coordination, when the control signal from the member-position controller drives the sliding and holding device 3D of the member-displacement mechanism 3 to reciprocate the member 2 to be plated in the horizontal direction (oscillating movement), in order that the relative positions of the movable anode 4B, the movable plating solution-ejecting portion 6J, and the NAU 8 to the member 2 do not vary even due to such reciprocating movement, the anode-position controller, the ejecting portion-position controller, and the NAU-position controller may be caused to output appropriate control signals to drive the sliding and holding devices 5C, 7C, and 9C.

The circulation controller 13D comprises: a pump controller which generates a control signal for controlling the action of a pump driver 14A to drive the pump 6C and outputs the control signal to the pump driver 14A; a first valve controller which generates a control signal for controlling the action of a first flow volume adjuster 14B to operate the first flow volume adjusting valve 6G and outputs the control signal to the first flow volume adjuster 14B; a second valve controller which generates a control signal for controlling the action of a second flow volume adjuster 14C to operate the second flow volume adjusting valve 6I and outputs the control signal to the second flow volume adjuster 14C; and a third valve controller which generates a control signal for controlling the action of a third flow volume adjuster 14D to operate the third flow volume adjusting valve 6O and outputs the control signal to the third flow volume adjuster 14D.

The circulation controller 13D can generate control signals for the above plural position controllers on the basis of the measured results by the measurement instruments 12A, 12B, 12C. In addition, the circulation controller 13D can use a predefined control program and/or an input signal from an interface device as the basis to generate control signals for the above plural position controllers. Further, the circulation controller 13D can individually generate control signals for the above plural controllers included therein, and also cause plural controllers to cooperate with one another. The first return pipe 6E, the second return pipe 6H, and the third return pipe 6L may be provided with respective flowmeters, and information from these flowmeters may be used as the basis to set the operation of each controller included in the circulation controller 13D.

The controller 13 can cause plural controllers included therein to cooperate with one another. A specific example of such cooperation will be described with reference to FIG. 3 as a sequential process in which the member 2 to be plated is located in the plating solution in the plating bath 1, a voltage is applied thereto from the plating electric power supply during a predetermined period of time, and the member 2 formed thereon with a plated film (plated member 2) is taken out of the plating solution in the plating bath 1.

Figure 3:
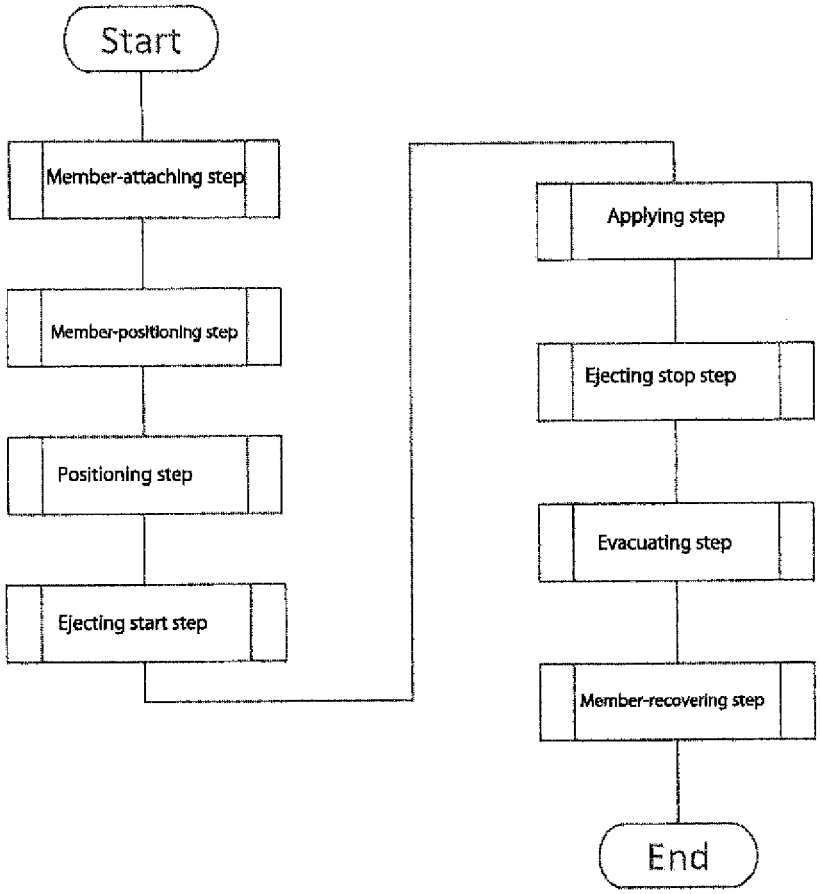
FIG. 3 is a flow diagram illustrating one example of the operation of the plating apparatus according to one embodiment of the present invention.

FIG. 3 is a flow diagram illustrating one example of the operation of the plating apparatus according to one embodiment of the present invention. According to the present example, a member-attaching step, a member-positioning step, a positioning step, an ejecting start step, an applying step, an ejecting stop step, an evacuating step, and a member-recovering step are performed in this order.

(Member-Attaching Step)

In the member-attaching step according to the present example, the control signal output from the member-position controller included in the position controller 13C is used as the basis to operate the sliding and holding device 3D of the member-displacement mechanism 3, and the control signal output from the fixing device controller included in the controller 13 is used as the basis to operate the fixing device 3A, so that the member 2 to be plated is fixed to the fixing device 3A. Details of this operation will be described later with reference to a specific example of the fixing device 3A.

(Member-Positioning Step)

In the member-positioning step, the control signal output from the member-position controller included in the position controller 13C is used as the basis to operate the sliding and holding device 3D of the member-displacement mechanism 3, and thereby at least a part of the member 2 to be plated, which has been fixed to the fixing device 3A due to carrying out the member-attaching step, is immersed into the plating solution in the plating bath 1.

(Positioning Step)

In the positioning step, components such as the movable anode 4B located in the plating bath 1 are moved so as to be more proximal to the member 2 to be plated. The relationship between the start timing of the positioning step and the start timing of the member-positioning step is not particularly limited. Either one may be started prior to the other, or both may be started at the same time. In the case where either one is started prior to the other, the relationship between the finish timing of one step and the start timing of the other step is not particularly limited. The other step may be started after the one step has been finished, or the other step may also be started before the one step has been finished.

In the positioning step according to the present example, three steps, i.e. an anode-positioning step, an ejecting portion-positioning step, and an NAU part-positioning step, are performed. The relationship among the start timings of these three steps is not particularly limited, and they may be started at the same time, or started in a given sequence.

In the anode-positioning step, the control signal output from the anode-position controller included in the position controller 13C is used as the basis to operate the sliding and holding device 5C of the anode-displacement mechanism 5, and thereby the movable anode 4B in the state of having been located at a predetermined position in the plating bath 1 (referred also to as "anode initial position") is moved so as to come close to the member 2 to be plated that has been located in the plating solution in the plating bath 1 due to carrying out the member-positioning step, i.e. so as to be more proximal to the member 2 to be plated, and held at a predetermined first position.

The first position where the movable anode 4B is located according to the anode-positioning step may be a position where the member 2 to be plated interferes with the movable anode 4B when the member 2 is moved so that the member 2 is taken out of the plating solution. In this case, the movable anode 4B is located at the first position after the member 2 to be plated has been in the state of being immersed in the plating solution to some extent according to the member-positioning step.

In general, an insoluble anode may sometimes be fixed to the plating bath 1 like the insoluble anode 4A. In such a case, it is impossible for the insoluble anode to be located at a position, like the above first position, which interferes with the action of taking out the member 2. In contrast, the insoluble anode included in the plating apparatus 100 according to the present embodiment is possible to be moved in the plating bath 1 like the movable anode 4B, so that the insoluble anode can be located even at a position which causes the interference with the member 2 to be plated. Therefore, according to the plating apparatus 100 of the present embodiment, the location of the insoluble anode can be appropriately set regardless of the shape of the member 2 to be plated.

As a specific example of such a location, there is a case where, for the whole surface to be plated of the member 2, the variation in the distance between the surface to be plated and the insoluble anode can be provided within a predetermined range (e.g. within 20%). In this case, the variation in the current density at the surface to be plated of the member 2 during plating is mainly due to that the solution resistance between the surface to be plated and the insoluble anode varies in accordance with the variation in the distance therebetween. Therefore, if the variation in the distance between the surface to be plated and the insoluble anode can be controlled within a predetermined range, then the variation in the current density at the surface to be plated is allowed to be suppressed, so that the plated film formed on the member 2 has an excellent uniformity of thickness and film property.

Moreover, such a small variation in the current density may render additives unnecessary to be contained in the plating solution for the purpose of enhancing the uniform electrodeposition ability, or otherwise reduce the content thereof. In general, additives for enhancing the uniform electrodeposition ability are likely to deteriorate the deposition rate of the plated film on a surface to be plated with high current density. As a consequence, the use of additives for enhancing the uniform electrodeposition ability tends to cause the deposition rate of the plated film to be low in whole, thereby making difficult to form a plated film at a high speed. In contrast, the use of the plating apparatus 100 according to the present embodiment may render additives as described above unnecessary or otherwise reduce the usage thereof, and it is thus easy to form the plated film on the member 2 at a high speed.

Furthermore, the use of additives as described above means that the utilization efficiency of energy is deteriorated compared with the case of additive-free because the deposition rate in plating remains low even with the increased current density. Therefore, if the plating is performed using the plating apparatus 100 according to the present embodiment so that no additive is used or otherwise the usage thereof is reduced, then the energy utilization efficiency in the plating treatment can be enhanced.

In the ejecting portion-positioning step, the control signal output from the ejecting portion-position controller included in the position controller 13C is used as the basis to operate the sliding and holding device 7C of the ejecting portion-displacement mechanism 7, and thereby the movable plating solution-ejecting portion 6J in the state of having been located at a predetermined position in the plating bath 1 (referred also to as "ejecting portion initial position") is moved so as to come close to the member 2 to be plated that has been located in the plating solution in the plating bath 1 due to carrying out the member-positioning step, i.e. so as to be more proximal to the member 2 to be plated, and held at a predetermined third position.

In a prior art plating apparatus, a plating solution ejecting portion in a plating solution circulation mechanism is fixed to a specified position relative to the plating solution like the fixed plating solution-ejecting portion 6F, so the flow of the plating solution may be insufficient at a position proximal to the fixed plating solution-ejecting portion. If the member 2 to be plated is located within a region where the flow of the plating solution is insufficient due to such a reason, then the supply of plating metal ions is insufficient for the surface to be plated that is located within the region thereby deteriorating the plating deposition rate compared to that for the other surface to be plated, and the thickness of the plated film is thus likely to vary.

In contrast, when the plating solution-ejecting portion 6J is movable in the plating bath 1 as in the plating apparatus 100 according to the present embodiment, even though there is a region where the supply of plating metal ions would be insufficient if only by the plating solution circulation from the fixed plating solution-ejecting portion as described above, the plating solution-ejecting portion 6J may be located so that the plating solution is ejected to that region, thereby making it easy to form the plated film having uniform thickness on the surface to be plated of the member 2. In particular, such a problem of short supply of the plating metal ions as the above is significant when the deposition rate is high, so the use of the plating apparatus 100 according to the present embodiment makes it easy to deposit the plating metal at a high speed. The third position may also be, like the first position, a position where the member 2 to be plated interferes with the plating solution-ejecting portion 6J when the member 2 is moved so that the member 2 is taken out of the plating solution.

In the NAU part-positioning step, the control signal output from the NAU-position controller included in the position controller 13C is used as the basis to operate the sliding and holding device 9C of the NAU-displacement mechanism 9, and thereby the NAU 8 in the state of having been located at a predetermined position in the plating bath 1 (referred also to as "NAU initial position") is moved so as to come close to the member 2 to be plated that has been located in the plating solution in the plating bath 1 due to carrying out the member-positioning step, i.e. so as to be more proximal to the member 2 to be plated, and held at a predetermined fifth position. The NAU 8 has both functions of the previously-described movable anode 4B and movable plating solution-ejecting portion 6J because of being such that the NAU anode 4C and the NAU ejecting portion 6M are integrated to be movable, and the plated film can thus be formed on the member 2 at a high speed and with high uniformity. The fifth position may also be, like the first position and the third position, a position where the member 2 to be plated interferes with the NAU 8 when the member 2 is moved so that the member 2 is taken out of the plating solution.

(Ejecting Start Step)

After the positioning step has been completed to locate the movable anode 4B, the plating solution-ejecting portion 6J, and the NAU 8 at the first position, the third position, and the fifth position, respectively, the second valve controller and the third valve controller both included in the circulation controller 13D output respective control signals to the second flow volume adjuster 14C and the third flow volume adjuster 14D, which use the input respective control signals as the basis to operate the second flow volume adjusting valve 6I and the third flow volume adjusting valve 6O thereby to eject the plating solution from the plating solution-ejecting portion 6J and the NAU ejecting portion 6M.

According to the method of the present example, the pump 6C and the first flow volume adjusting valve 6G continue to operate from the stage of the member-positioning step, and hence the circulation of the plating solution by the first circulation system is continuously performed, so that a strainer provided in the outward pipe 6B is to remove foreign substances and the like contained in the plating solution.

Although the ejecting start step is performed after the positioning step in the present example, the ejecting start step may be initiated prior to or in the middle of the positioning step, or the ejection of the plating solution may also be continuously performed from the plating solution-ejecting portion 6J and the plating solution-ejecting portion 6M of the NAU 8 like in the case of the first return pipe 6E without providing any ejecting start step. Alternatively, after setting a situation where a small volume of the plating solution is continuously ejected from the plating solution-ejecting portion 6J and the plating solution-ejecting portion 6M of the NAU 8, the ejecting start step may increases the ejecting volume therefrom.

(Applying Step)

In the applying step, the control signals from the electric-output controller 13B are used as the basis to operate the plating electric power supply 10, and thereby voltages are applied between the member 2 to be plated and the insoluble anodes 4A-4C during a predetermined period of time to form a plated film on the member 2. These voltage values may be, such as, but not particularly limited, appropriately set with consideration for the shape of the member 2 to be plated, the type of plating, the thickness of the plated film to be obtained, and other factors. When the voltages are applied, voltage values may be controlled, and/or current values may be controlled.

The electric-output controller 13B may perform a control such that currents or voltages vary during the applying step. Such variations may be performed in accordance with a predefined program, in response to the input operation from a user interface device, and/or by means of feedback control as will be described below.

In this feedback control, using input signals regarding currents and/or voltages measured at the measurement instrument 12A on the wiring 11A to the fixed anode 4A, the measurement instrument 12B on the wiring 11B to the movable anode 4B, and the measurement instrument 12C on the wiring 11C to the NAU anode 4C, the electric-output controller 13B included in the controller 13 generates signals for controlling at least one of currents and voltages applied to the fixed anode 4A, the movable anode 4B, and the NAU anode 4C, and outputs the signals to the plating electric power supply 10. The plating electric power supply 10 supplied with these signals uses them as the basis to vary currents and/or voltages to be applied to at least one of the fixed anode 4A, the movable anode 4B, and the NAU anode 4C.

A specific example of the above feedback control may be such that, if the current value measured by the measurement instrument 12C on the wiring 11C to the NAU anode 4C decreases below a predetermined value and the deposition rate of the plated metal decreases accordingly, then the voltage applied to the NAU anode 4C is increased, and thereafter, when the current value measured by the measurement instrument 12C on the wiring 11C to the NAU anode 4C recovers to a predetermined value, the applied voltage is held.

In addition, positions of at least one of the member 2 to be plated, the movable anode 4B, the movable plating solution-ejecting portion 6J, and the NAU 8 in the plating bath 1 may be varied in the applying step. Such variations may be performed in accordance with a predefined program, in response to the input operation from a user interface device, and/or by means of feedback control as will be described below.

In this feedback control, using input signals regarding currents and/or voltages measured at the measurement instrument 12A on the wiring 11A to the fixed anode 4A, the measurement instrument 12B on the wiring 11B to the movable anode 4B, and the measurement instrument 12C on the wiring 11C to the NAU anode 4C, the position controller 13C included in the controller 13 generates signals for controlling at least one of the sliding and holding devices 3D, 5C, 7C, and 9C, and outputs the signals to the corresponding sliding and holding devices 3D, 5C, 7C, and/or 9C. The sliding and holding devices 3D, 5C, 7C, and/or 9C supplied with these signals use them as the basis to vary the positions of at least one of the member 2 to be plated, the movable anode 4B, the movable plating solution-ejecting portion 6J, and the NAU 8 in the plating bath 1.

A specific example of the above feedback control may be such that, if the current value measured by the measurement instrument 12C on the wiring 11C to the NAU anode 4C decreases below a predetermined value and the deposition rate of the plated metal decreases accordingly, then the NAU 8 is moved so as to be more proximal to the member 2 to be plated, and thereafter, when the current value measured by the measurement instrument 12C on the wiring 11C to the NAU anode 4C recovers to a predetermined value, the position is held.

The controller 13 may also subject the member 2 to be plated to oscillating movement in the plating bath 1 by coordinating the sliding and holding devices 3D, 5C, 7C, and 9C. The prior art plating apparatus is such that the insoluble anode is fixed to a certain position in the plating bath, so if the member to be plated is subjected to oscillating movement in the plating bath, then the relative relationship of the member to the insoluble anode varies due to the oscillating movement of the member in the plating bath. In contrast, according to the plating apparatus 100 of the present embodiment, the member 2 to be plated can be subjected to oscillating movement in the plating bath 1 while maintaining the relative relationship thereof to the movable anode 4B and the NAU anode 4C. Therefore, if any voltage is not applied to the fixed anode 4A, then the member 2 to be plated can be subjected to oscillating movement in the plating bath 1 substantially without changing the current density at the surface to be plated of the member 2.

Furthermore, ejecting volumes of the plating solution from at least one of the fixed plating solution-ejecting portion 6F, the movable plating solution-ejecting portion 6J, and the NAU ejecting portion 6M may be varied in the applying step. Such variations may be performed in accordance with a predefined program, in response to the input operation from a user interface device, and/or by means of feedback control as will be described below.

In this feedback control, using input signals regarding currents and/or voltages measured at the measurement instrument 12A on the wiring 11A to the fixed anode 4A, the measurement instrument 12B on the wiring 11B to the movable anode 4B, and the measurement instrument 12C on the wiring 11C to the NAU anode 4C, the circulation controller 13D included in the controller 13 generates signals for controlling at least one of the first flow volume adjusting valve 6G, the second flow volume adjusting valve 6I, and the third flow volume adjusting valve 6O, and outputs the signals to the corresponding first flow volume adjusting valve 6G, second flow volume adjusting valve 6I, and/or third flow volume adjusting valve 6O. The first flow volume adjusting valve 6G, the second flow volume adjusting valve 6I, and/or the third flow volume adjusting valve 6O supplied with these signals use them as the basis to vary the ejecting volumes of the plating solution from at least one of the fixed plating solution-ejecting portion 6F, the movable plating solution-ejecting portion 6J, and the NAU ejecting portion 6M.

A specific example of the above feedback control may be such that, if the current value measured by the measurement instrument 12C on the wiring 11C to the NAU anode 4C decreases below a predetermined value and the deposition rate of the plated metal decreases accordingly, then the ejecting volume of the plating solution from the NAU ejecting portion 6M is increased, and thereafter, when the current value measured by the measurement instrument 12C on the wiring 11C to the NAU anode 4C recovers to a predetermined value, the ejecting volume is held.

The above plural feedback controls may be independent or performed to be coordinated with one another.

(Ejecting Stop Step)

In the ejecting stop step, the ejection of plating solution from such as the movable plating solution-ejecting portion 6J and the NAU ejecting portion 6M is terminated. Specifically, the second valve controller and the third valve controller included in the circulation controller 13D output respective control signals to the second flow volume adjuster 14C and the third flow volume adjuster 14D, which use these control signals as the basis to operate the second flow volume adjusting valve 6I and the third flow volume adjusting valve 6O thereby to stop ejecting the plating solution from the plating solution-ejecting portion 6J and the NAU ejecting portion 6M.

The timing of starting the ejecting stop step is not particularly limited if being after the applying step. As a result of carrying out the evacuating step, which will be described below, if the plating solution ejection is in a state capable of being performed into the plating solution in the plating bath 1, then the ejecting stop step may be performed after the evacuating step has been completed, or the plating solution ejection such as from the plating solution-ejecting portion 6J and the NAU ejecting portion 6M may also be continuously performed like from the fixed plating solution-ejecting portion 6F without performing the ejecting stop step.

(Evacuating Step)

In the evacuating step, movable components such as movable anode 4B located in the plating bath 1 are moved so as to be more distal from the member formed thereon with the plated film. The timing of performing the evacuating step is not particularly limited if being after the applying step. The relationship with the above ejecting stop step is freely determined. Moreover, if movable components such as the movable anode 4B located at a predetermined position in the previously described positioning step do not interfere with the plated member 2 to be taken out of the plating solution in the member-recovering step as will be described later, then the evacuating step may be performed after the member-recovering step.

In the evacuating step according to the present example, three steps, i.e. an anode-evacuating step, an ejecting portion-evacuating step, and an NAU-evacuating step, are performed. The relationship among the start timings of these three steps is not particularly limited, and they may be started at the same time, or started in a given sequence.

In the anode-evacuating step, the control signal output from the anode-position controller included in the position controller 13C is used as the basis to operate the sliding and holding device 5C of the anode-displacement mechanism 5, and thereby the movable anode 4B in the state of having been held at a predetermined position (e.g. the first position) in the plating bath 1 due to the completion of the applying step is moved so as to depart from the member 2 formed thereon with a plated film (plated member 2) due to the completion of the applying step, i.e. so as to be more distal from the plated member 2, and held at a predetermined second position. This second position may be the anode initial position as a position where the movable anode 4B was initially located at the time during the anode-positioning step.

If the predetermined position in the plating bath 1 is, due to the completion of the applying step, a position where the plated member 2 interferes with the movable anode 4B when the plated member 2 is taken out of the plating solution, then the member-recovering step, which will be described later, is performed after the anode-evacuating step of moving the movable anode 4B to the second position has been performed.

In the ejecting portion-evacuating step, the control signal output from the ejecting portion-position controller included in the position controller 13C is used as the basis to operate the sliding and holding device 7C of the ejecting portion-displacement mechanism 7, and thereby the plating solution-ejecting portion 6J in the state of having been held at a predetermined position (e.g. the third position) in the plating bath 1 due to the completion of the applying step is moved so as to depart from the plated member 2, i.e. so as to be more distal from the plated member 2, and held at a predetermined fourth position. This fourth position may be the ejecting portion initial position as a position where the plating solution-ejecting portion 6J is initially located at the time during the ejecting portion-positioning step.

In the NAU-evacuating step, the control signal output from the NAU-position controller included in the position controller 13C is used as the basis to operate the sliding and holding device 9C of the NAU-displacement mechanism 9, and thereby the NAU 8 in the state of having been held at a predetermined position (e.g. the fifth position) in the plating bath 1 due to the completion of the applying step is moved so as to depart from the plated member 2, i.e. so as to be more distal from the plated member 2, and held at a predetermined sixth position. This sixth position may be the NAU initial position as a position where the NAU 8 is initially located at the time during the NAU-positioning step.

(Member-Recovering Step)

In the member-recovering step, the control signal output from the member-position controller included in the position controller 13C is used as the basis to operate the sliding and holding device 3D of the member-displacement mechanism 3, and thereby the member 2 in the state where the plated film has been formed on the surface of the immersed portion is taken out of the plating bath 1 and obtained as the plated member.

The configuration of the plating apparatus according to the present embodiment will then be described with reference to further specific examples shown in FIG. 4 to FIG. 18.

Figure 4:
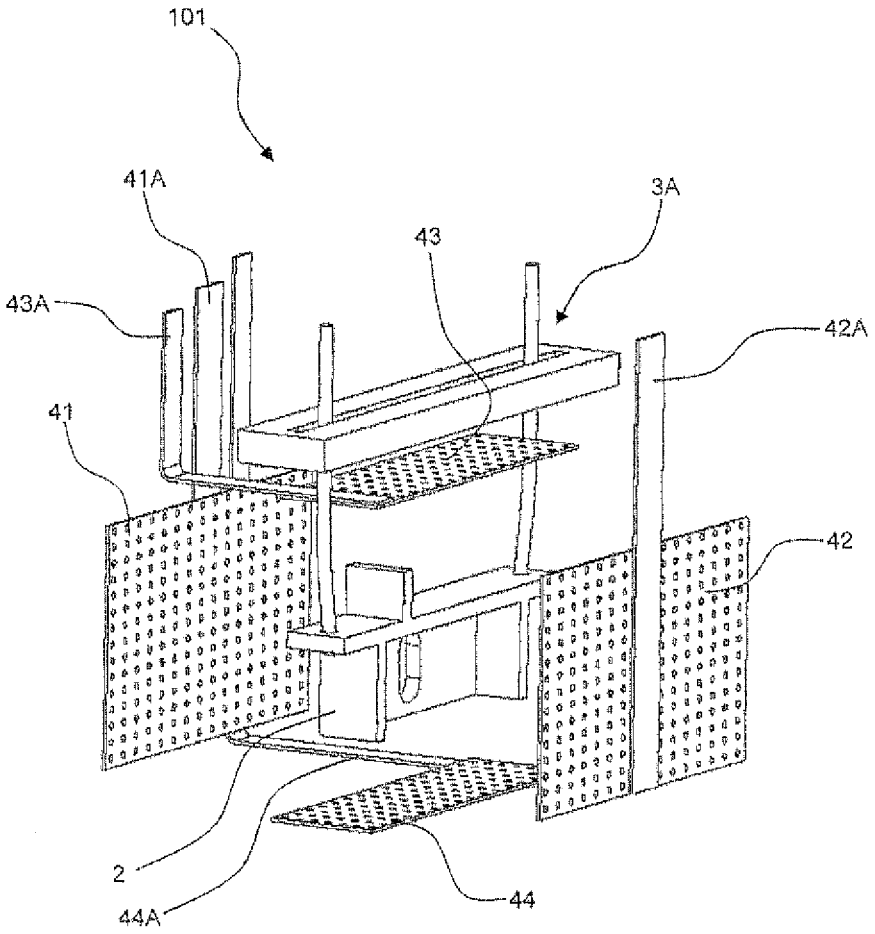
FIG. 4 is a perspective view conceptually illustrating an arrangement of members in the plating bath of a plating apparatus according to one example of the present embodiment (example having no movable plating solution-ejecting portion).

FIG. 4 is a perspective view conceptually illustrating an arrangement of members in the plating bath of a plating apparatus according to one example of the present embodiment. Plating apparatus 101 according to the present example has plural movable anodes.

The plating apparatus 101 according to the present example is such that a member 2 to be plated having complex three-dimensional shape is held by a fixing device 3A so as to be located at a predetermined position in a plating bath 1 not shown. Fixing method for the member 2 by the fixing device 3A will be described later. The plating apparatus 101 according to the present example comprises movable anodes 41 to 44 each being planar plate-like and having plural through holes.

Each movable anode 41, 42, 43, 44 is individually movable by a corresponding anode-displacement mechanism 5 not shown and comprises a connection bar 41A, 42A, 43A, 44A which provides a connecting part with each anode-displacement mechanism 5. Among these movable anodes 41, 42, 43, 44, movable anodes 41, 42 are located to face respective two surfaces that are maximum surfaces of a minimum rectangular cuboid which encloses the member 2 to be plated and which has four sides in the direction parallel to the vertical direction. Hereinafter, this rectangular cuboid will be referred to as circumscribed rectangular cuboid.

The movable anode 43 is located above the member 2 to be plated. As previously described, member-displacement mechanism 3 not shown lifts up the fixing device 3A thereby to take out the member 2 from the plating solution, so the movable anode 43 is located at a position which interferes with the taking out operation for the member 2 by the fixing device 3A. However, the movable anode 43 is held by the anode-displacement mechanism 5 not shown via the connection bar 43A, and can thus be evacuated to a position which does not interfere when the taking out operation for the member 2 is performed by the fixing device 3A. The movable anode 44 is located below the member 2 to be plated.

Figure 5:
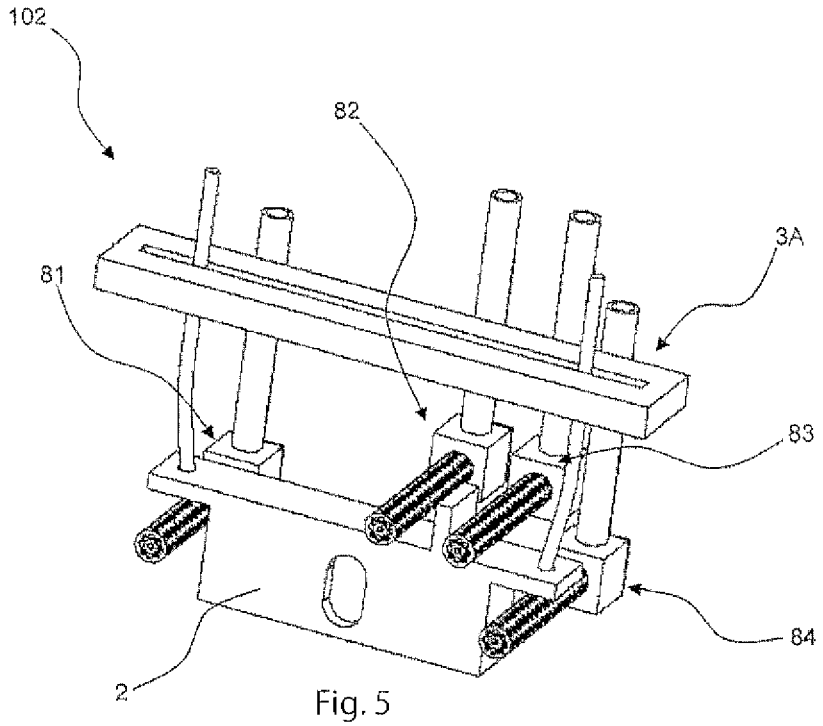
FIG. 5 is a perspective view conceptually illustrating an arrangement of members in the plating bath of a plating apparatus according to one example of the present embodiment (example comprising nozzle-anode units of tubular shape).

FIG. 5 is a perspective view conceptually illustrating an arrangement of members in the plating bath of a plating apparatus according to another example of the present embodiment. Plating apparatus 102 according to the present example has plural NAUs.

The plating apparatus 102 according to the present example is such that a member 2 to be plated having complex three-dimensional shape is held by a fixing device 3A so as to be located at a predetermined position in a plating bath 1 not shown. The plating apparatus 102 according to the present example comprises NAUs (referred also to as "tubular NAUs", hereinafter) 81, 82, 83, 84 of which each NAU anode has tubular shape. In the present example, the tubular NAUs 81, 82, 83, 84 have the same structure.

These tubular NAUs 81, 82, 83, 84 are located at positions near curved portions of the member 2 to be plated. Here, the tubular NAUs 82, 83 are located at positions which interfere with the taking out operation for the member 2 by the fixing device 3A. However, the tubular NAUs 81, 82, 83, 84 are held by the NAU-displacement mechanism 9 not shown in FIG. 5 via connection bars also not shown, so that the NAUs 82, 83 can be evacuated to positions which do not interfere when the taking out operation for the member 2 is performed by the fixing device 3A.

Figure 6:
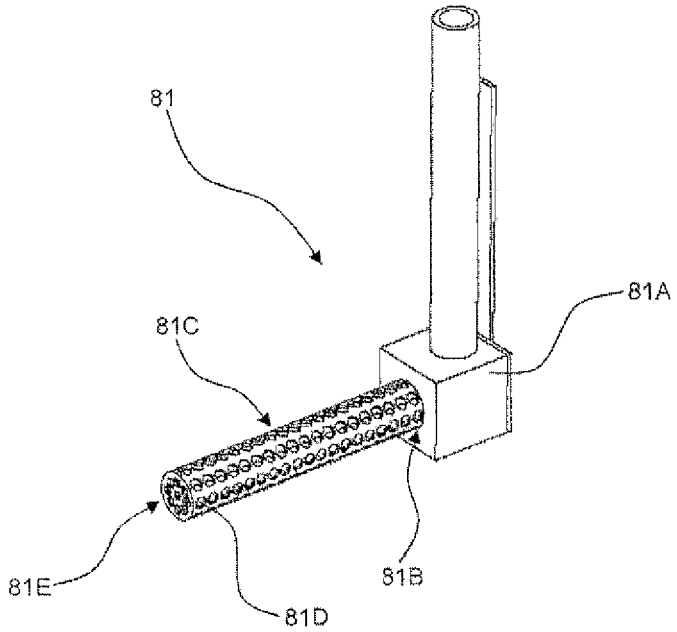
FIG. 6 is a perspective view conceptually illustrating the structure of nozzle-anode unit shown in FIG. 5.
Figure 7:
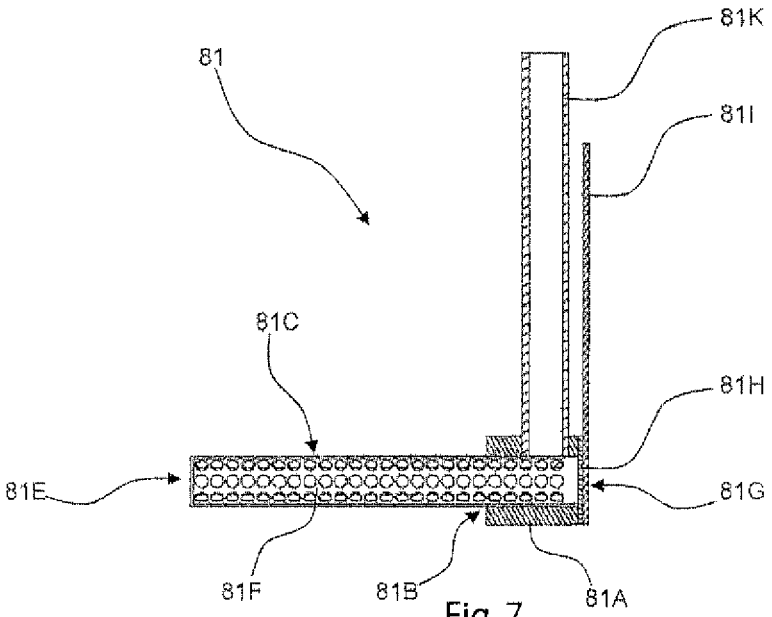
FIG. 7 is a cross-sectional view conceptually illustrating the structure of nozzle-anode unit shown in FIG. 5.
Figure 8:
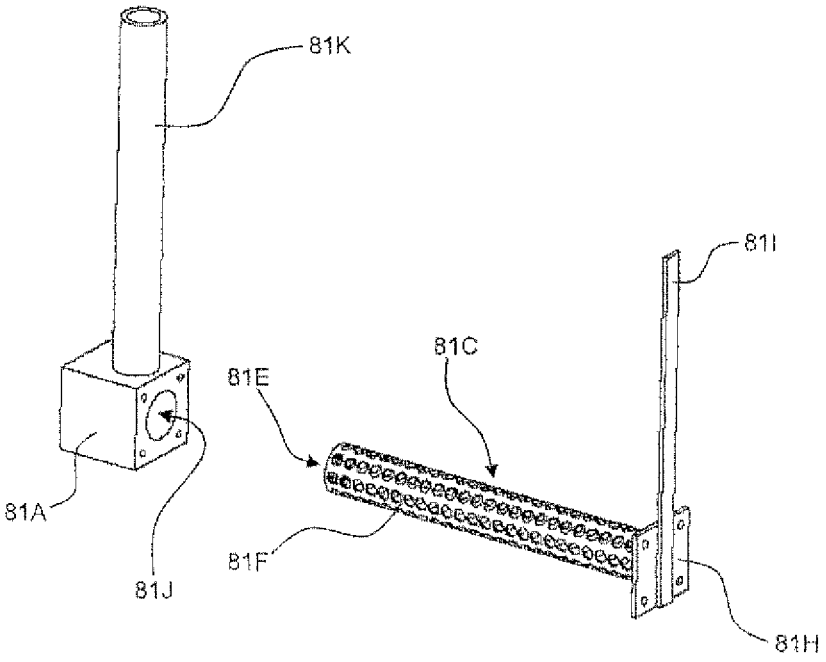
FIG. 8 is a perspective view conceptually illustrating respective structures of a plating solution-ejecting portion that constitutes the nozzle-anode unit shown in FIG. 5 and an insoluble anode that comprises a part having a tubular shape.

Specific structure of the tubular NAU 81 will be described with reference to FIG. 6 to FIG. 8. FIG. 6 is a perspective view conceptually illustrating the structure of the tubular NAU. FIG. 7 is a cross-sectional view conceptually illustrating the structure of the tubular NAU. FIG. 8 is a perspective view conceptually illustrating respective structures of a plating solution-ejecting portion that constitutes the tubular NAU and an insoluble anode that comprises a part having a tubular shape.

The tubular NAU 81 comprises: a plating solution-ejecting portion 81A which is located in a plating bath 1 for returning the plating solution in the plating bath 1, suctioned from a plating solution-suctioning portion 6A, back to the plating bath 1 using circulation by a pump 6C; and an insoluble anode 81C of which at least a part is located at a position from which an ejecting hole 81B of the plating solution-ejecting portion 81A is in view. NAU 8 is such that the relative position of NAU anode 4C to ejecting hole 6N of NAU ejecting portion 6M is managed, and particularly in the tubular NAU 81 as one example of the NAU 8, the relative position of the insoluble anode 81C to the ejecting hole 81B is fixed. Another example of the management for the relative position of the NAU anode 4C to the ejecting hole 6N of the NAU ejecting portion 6M may be such that a driver is additionally provided which varies or holds relative positions of the NAU ejecting portion 6M and the NAU anode 4C and which is controlled by the controller 13.

The insoluble anode 81C according to the present example is such that the part located at the position from which the ejecting hole 81B of the plating solution-ejecting portion 81A is in view has a shape of tubular structure obtained by fabricating a planar member having plural through-holes 81D to a tubular shape.

The tubular shape of the insoluble anode 81C is a shape that guides the plating solution in a certain direction. If the insoluble anode 81C is not provided, then the plating solution is ejected from the ejecting hole 81B of the plating solution-ejecting portion 81A and the large part thereof proceeds in a direction parallel to the normal of the surface provided by the aperture of the ejecting hole 81B (this direction will be referred to as "simple ejecting direction"). In contrast, the insoluble anode 81C according to the present example is provided thereby resulting in that the plating solution ejected from the plating solution-ejecting portion 81A is first guided to the inside of the tubular insoluble anode 81C and then ejected into the plating bath from the plural through-holes 81D provided in the insoluble anode 81C. Consequently, the plating solution proceeds not only in the simple ejecting direction but also in directions perpendicular thereto. Therefore, the arrangement of the tubular NAUs 81 to 84 as shown in FIG. 5 allows the plating solution to be ejected in such directions that can directly deliver the plating solution to the curved portions of the member 2 to be plated. In general, the curved portions are sometimes unlikely to be supplied with plating metal ions because the flow of the plating solution tends to be relatively small at such curved portions, but by using the tubular NAUs 81 to 84, a sufficient amount of plating metal ions can be supplied to such curved portions.

The structure of the tubular NAU 81 will hereinafter be further specifically described. The tubular insoluble anode 81C has a portion 81F comprised of a tubular body of which a first end 81E as one end is located at a position from which the ejecting hole 81B of the plating solution-ejecting portion 81A is in view. In addition, a second end 81G as the opposite end to the first end 81E of the portion (also referred to as "tubular portion", hereinafter) 81F comprised of the tubular body is covered up with a planar member 81H having an inscribed circle of a diameter larger than that of a circumscribed circle of an aperture at the second end 81G. In the present example, the tubular portion 81F and the planar member 81H are separately manufactured and then integrated by welding. Further, the planar member 81H is welded with a conductive connection bar 81I for being connected with the NAU-displacement mechanism 9 not shown.

The plating solution-ejecting portion 81A has a through-hole 81J of which one aperture is the ejecting hole 81B for the plating solution, and the tubular portion 81F is set inside from the other aperture-side of the through-hole 81J so that the first end 81E is located at the position from which the ejecting hole 81B is in view. As shown in FIG. 8, screw holes are provided on a surface that includes the other aperture of the through-hole 81J of the plating solution-ejecting portion 81A, and corresponding through-holes are provided in the planar member 81H located to contact with that surface, so bolts are screwed into those screw holes via the through-holes thereby causing the plating solution-ejecting portion 81A and the tubular insoluble anode 81C to be fixed to each other.

As shown in FIG. 7, the plating solution-ejecting portion 81A is provided with a hollow pipe 81J in a direction perpendicular to the center axis of the through-hole 81J, and the hollow portion of the hollow pipe 81K is in communication with the through-hole 81J. The hollow pipe 81K has one end attached thereto with the plating solution-ejecting portion 81A, and the opposite end thereto is connected with a third return pipe 6L not shown. Therefore, the plating solution from the third return pipe 6L passes through the hollow portion of the hollow pipe 81K, reaches the inside of the through-hole 81J of the plating solution-ejecting portion 81A, is further guided from the ejecting hole 81B to the inside of the tubular portion 81F of the tubular insoluble anode 81C, and is ejected from the through-holes 81D of the tubular portion 81F into the plating bath 1.

Figure 9:
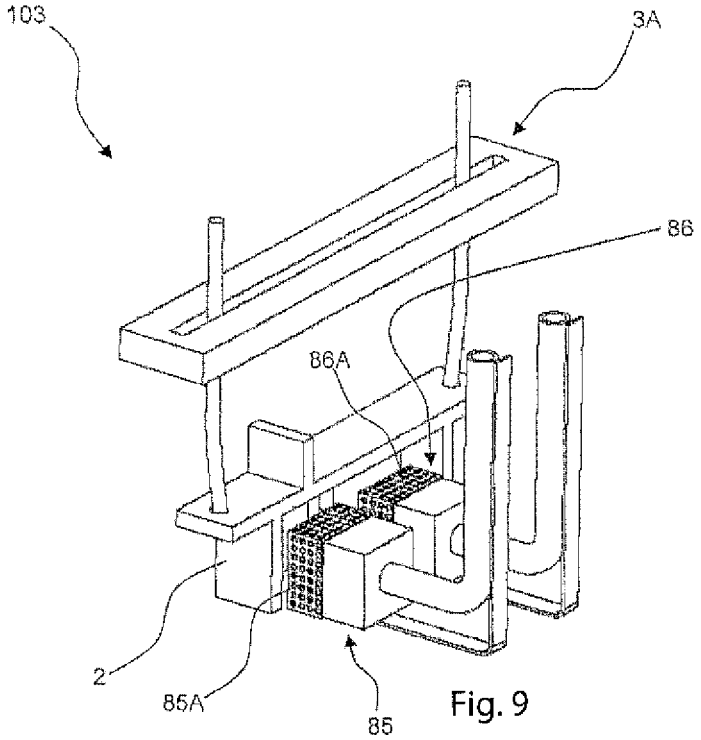
FIG. 9 is a perspective view conceptually illustrating an arrangement of members in the plating bath of a plating apparatus according to one example of the present embodiment (example comprising nozzle-anode units of box-type shape).

FIG. 9 is a perspective view conceptually illustrating an arrangement of members in the plating bath of a plating apparatus according to yet another example of the present embodiment. Plating apparatus 103 according to the present example has plural NAUs.

The plating apparatus 103 according to the present example is such that a member 2 to be plated having complex three-dimensional shape is held by a fixing device 3A so as to be located at a predetermined position in a plating bath 1 not shown. The plating apparatus 103 according to the present example comprises NAUs (also referred to as "box NAUs", hereinafter) 85, 86 of which each NAU anode has box shape. In the present example, the box NAUs 85, 86 have the same structure.

These box NAUs 85, 86 are such that their insoluble anodes 85A, 86A are located so as to come into inside the rectangular cuboid of the member 2 to be plated, and to face the member 2 at positions which are proximal to a portion (referred to as "recessed portion", hereinafter) recessed from the rectangular cuboid. Such an arrangement allows a sufficient amount of plating metal ions to be supplied to the recessed portion, and the plating film having an appropriate thickness can thus be easily formed even in the recessed portion. Such an arrangement also allows a sufficient amount of plating metal ions to be supplied to the inside of a through-hole provided in the member 2, and the plated film having an appropriate thickness can thereby be easily formed even in such a through-hole.

Figure 10:
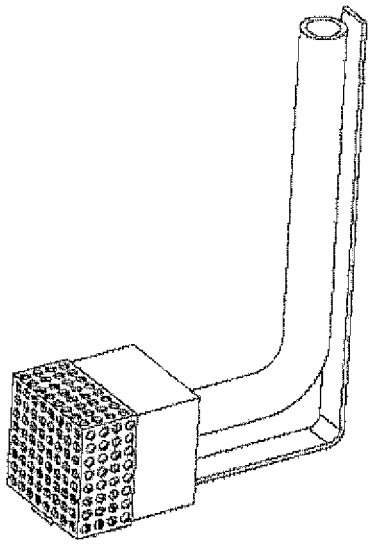
FIG. 10 is a perspective view conceptually illustrating the structure of nozzle-anode unit shown in FIG. 9.
Figure 11:
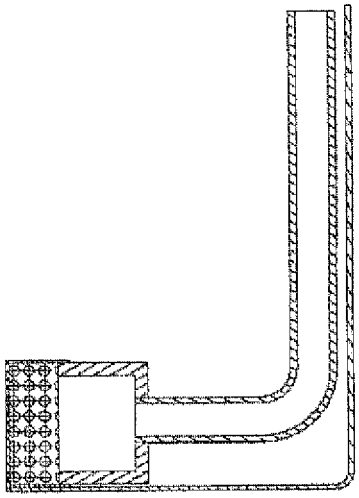
FIG. 11 is a cross-sectional view conceptually illustrating the structure of nozzle-anode unit shown in FIG. 9.
Figure 12:
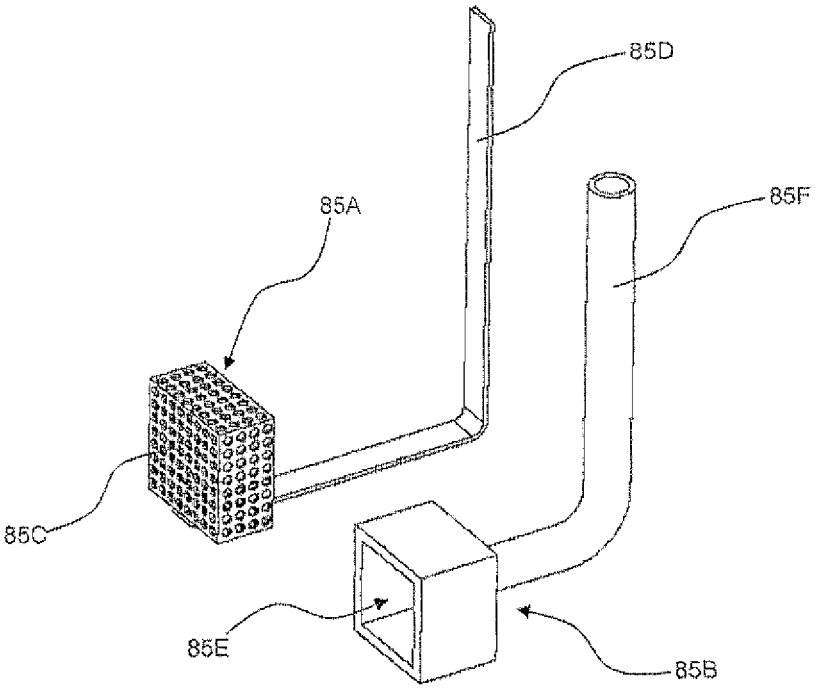
FIG. 12 is a perspective view conceptually illustrating respective structures of a plating solution-ejecting portion that constitutes the nozzle-anode unit shown in FIG. 9 and an insoluble anode that comprises a part having a basket-type shape.

FIG. 10 to FIG. 12 are views for explaining the structure of the box NAU 85, wherein FIG. 10 is a perspective view conceptually illustrating the structure of the box NAU, FIG. 11 is a cross-sectional view conceptually illustrating the structure of the box NAU, and FIG. 12 is a perspective view conceptually illustrating respective structures of a plating solution-ejecting portion that constitutes the box NAU and an insoluble anode that comprises a part having a basket-type shape.

As shown in FIG. 12, the box NAU 85 comprises: an insoluble anode 85A which has a shape of basket-type structure obtained by fabricating a planar member having plural through-holes 85C and is welded with a connection bar 85D for being connected with the NAU-displacement mechanism 9 not shown; and a plating solution-ejecting portion 85B of which one aperture is an ejecting hole 85E for the plating solution and the other aperture is in communication with the hollow portion of a hollow pipe 85F. As shown in FIG. 10, the part having a basket-type shape of the insoluble anode 85A is fixed to a position from which the ejecting hole 85E of the plating solution-ejecting portion 85B is in view.

The hollow pipe 85F has one aperture which faces the plating solution-ejecting portion 85B, and the opposite aperture thereto is connected with a third return pipe 6L not shown. Therefore, the plating solution from the third return pipe 6L passes through the hollow portion of the hollow pipe 85F, reaches the inside of the plating solution-ejecting portion 85B, is further guided from the ejecting hole 85E to the inside of the insoluble anode 85A, and is ejected from the through-holes 85C of the insoluble anode 85A into the plating bath.

Figure 13:
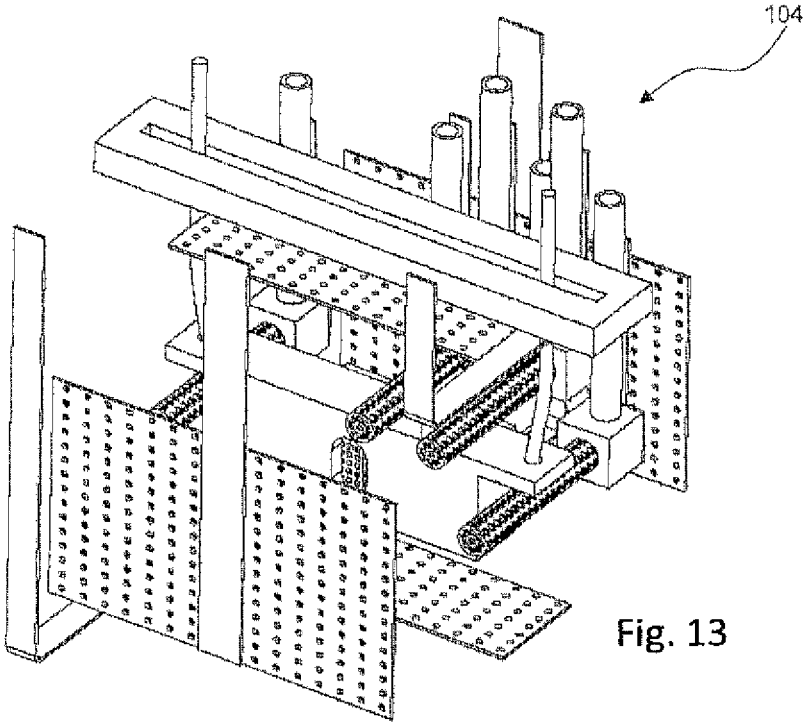
FIG. 13 is a perspective view, viewed from above, conceptually illustrating an arrangement of members in the plating bath of a plating apparatus as one example of the present embodiment wherein the insoluble anodes and the nozzle-anode units shown in FIG. 4, FIG. 5 and FIG. 9 are all located in the plating bath.
Figure 14:
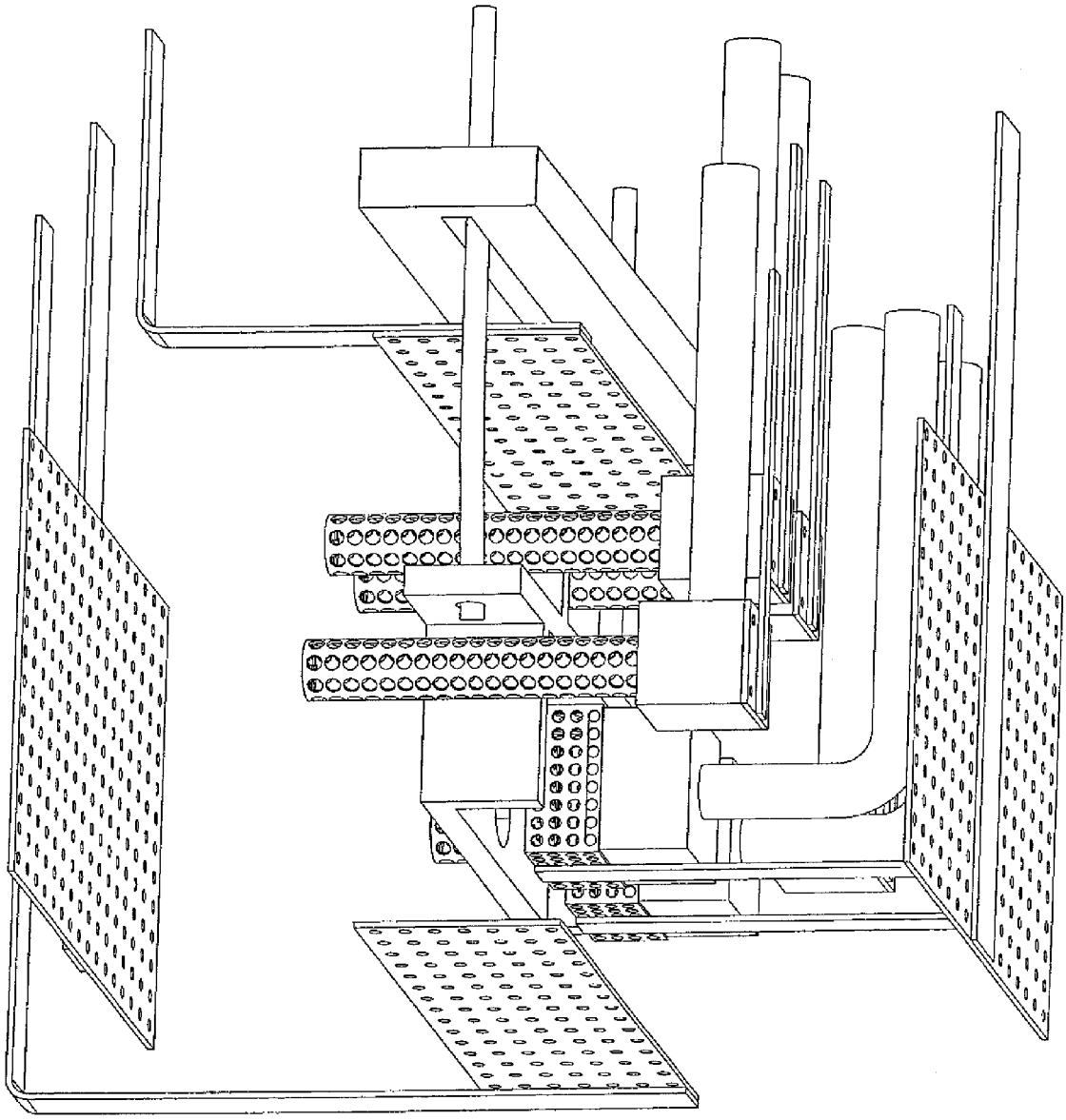
FIG. 14 is a perspective view, viewed from below, conceptually illustrating the arrangement of members in the plating bath of the plating apparatus according to the example shown in FIG. 13
Figure 15:
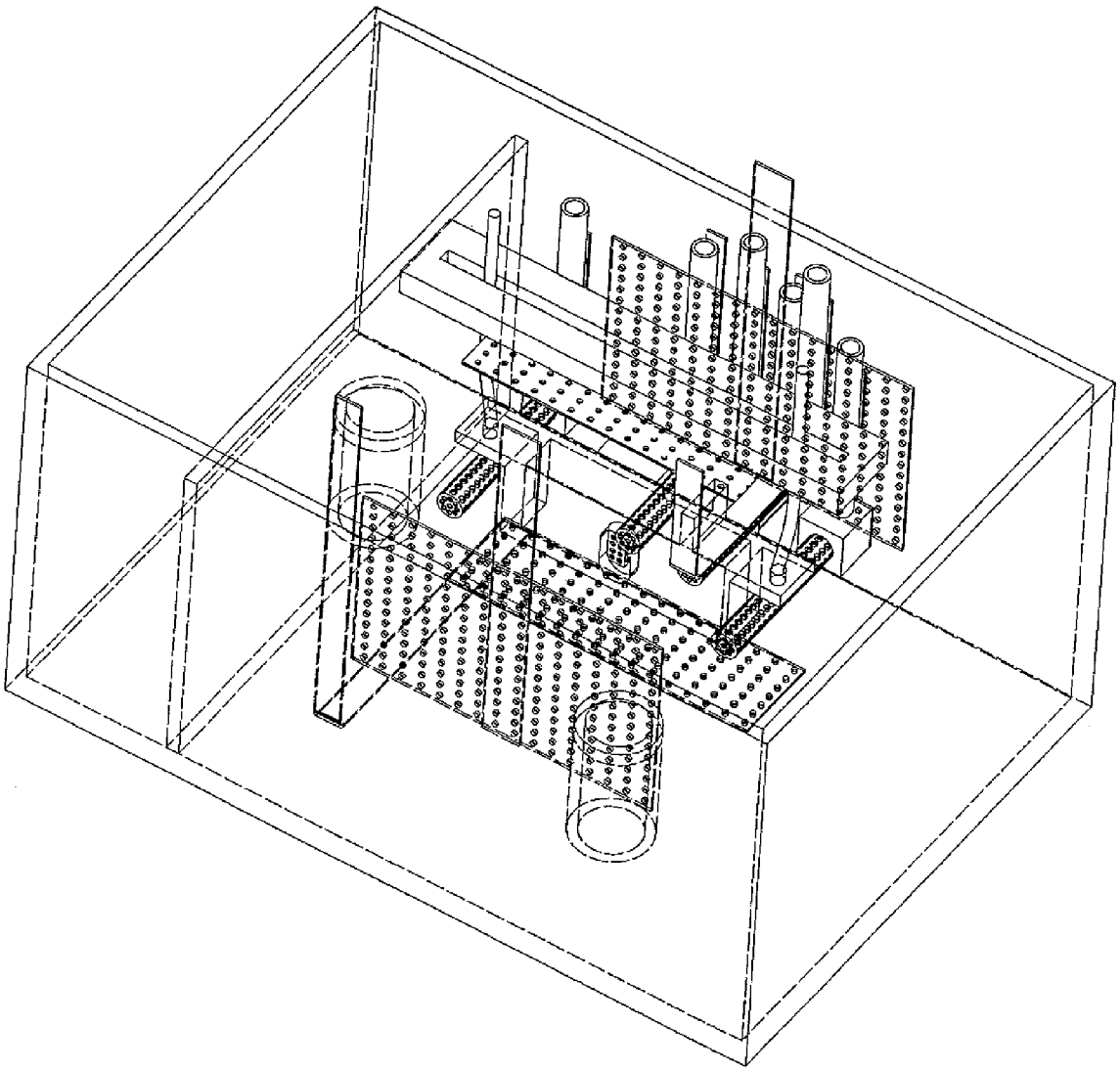
FIG. 15 is a perspective view conceptually illustrating an arrangement of the plating bath and members in the plating bath of the plating apparatus according to the example shown in FIG. 13.

FIG. 13 to FIG. 15 are views conceptually illustrating an arrangement of members in the plating bath of a plating apparatus according to still another example of the present embodiment. Specifically, FIG. 13 is a perspective view, viewed from above, conceptually illustrating the arrangement of members in the plating bath of the plating apparatus according to the present example while FIG. 14 is a perspective view viewed from below. FIG. 15 is a perspective view conceptually illustrating an arrangement of the plating bath and members in the plating bath of the plating apparatus according to the present example.

Plating apparatus 104 according to the present example comprises: a member 2 to be plated held by a fixing device 3A; movable anodes 41, 42, 43, 44 like in the plating apparatus 101; tubular NAUs 81, 82, 83, 84 like in the plating apparatus 102; and box NAUs 85, 86 like in the plating apparatus 103. As shown in FIG. 15, these are all located within the main region of plating bath 1. When the member 2 to be plated is subjected to oscillating movement such as by member-displacement mechanism 3 not shown, positions of the movable anodes 41, 42, 43, 44, the tubular NAUs 81, 82, 83, 84, and the box NAUs 85, 86 (also referred collectively to as "movable components", hereinafter) may be varied in synchronization with the oscillating movement thereby allowing the member 2 to be subjected to oscillating movement while maintaining the relative positional relationship between the member 2 and the movable components. Alternatively, each of the movable components may also be varied in its relative positional relationship with the member 2 to be plated during such oscillating movement.

Figure 16:
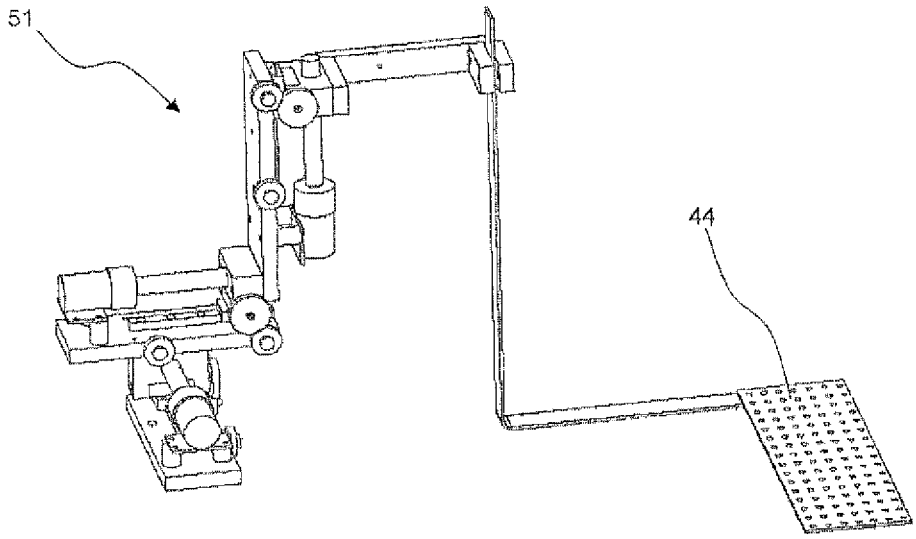
FIG. 16 is a perspective view conceptually illustrating the structure of an anode-displacement mechanism for the insoluble anode included in the plating apparatus according to the example shown in FIG. 4.
Figure 17:
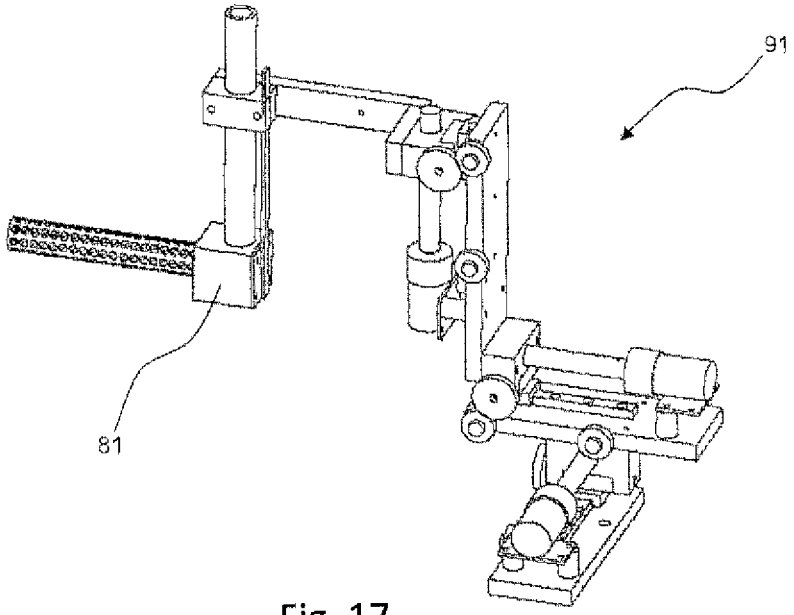
FIG. 17 is a perspective view conceptually illustrating the structure of an NAU-displacement mechanism for the nozzle-anode unit included in the plating apparatus according to the example shown in FIG. 5

Specific structural examples of displacement mechanisms for movable components will then be described with reference to FIG. 16 and FIG. 17. FIG. 16 is a perspective view conceptually illustrating the structure of an anode-displacement mechanism 51 for the insoluble anode 44 included in the plating apparatus 101. FIG. 17 is a perspective view conceptually illustrating the structure of an NAU-displacement mechanism 91 for the tubular NAU 81 included in the plating apparatus 102.

According to the examples shown in FIG. 16 and FIG. 17, each displacement mechanism for a movable component comprises three linear movement mechanisms which employ ball screws using stepping motors. The connection bar and the hollow pipe are attached to ends of these movement mechanisms, and positions of the insoluble anode 44 and the tubular NAU 81 can thereby be varied in the plating bath 1.

Figure 18:
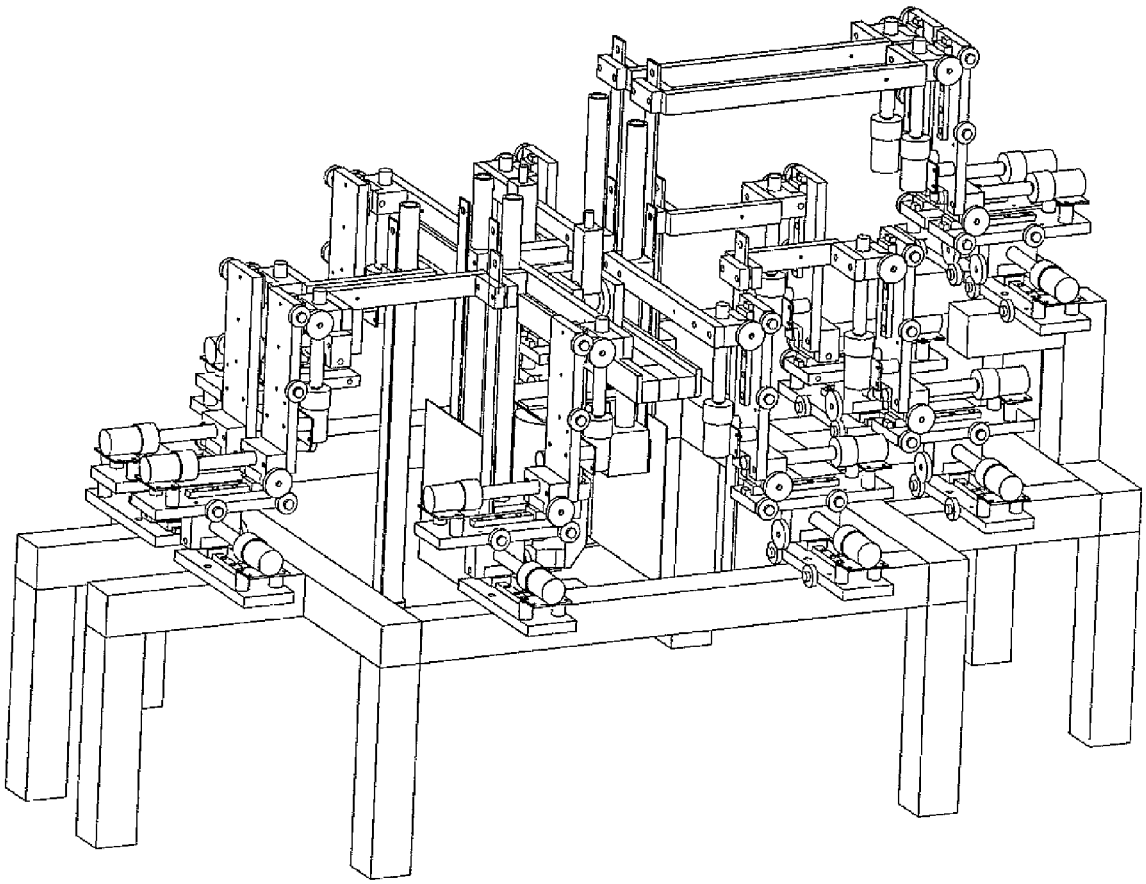
FIG. 18 is a perspective view conceptually illustrating a configuration that involves insoluble anodes, nozzle-anode units, a member to be plated, a part of a fixing apparatus for the member to be plated, an anode-displacement mechanism, an NAU-displacement mechanism, a member-displacement mechanism, and a frame for holding each mechanism, which are all included in the plating apparatus according to the example shown in FIG. 13.

FIG. 18 is a perspective view conceptually illustrating a configuration that involves movable components, displacement mechanisms for the movable components, a part of a fixing apparatus for a member to be plated, a member-displacement mechanism, and a frame for holding each mechanism, which are all included in the plating apparatus 104. The movable components can be appropriately located in the plating bath by appropriately setting the shape of the frame and also appropriately setting the shape of connection bars, the shape of hollow pipes, and the shape of end parts of the displacement-mechanisms for movable components to which the connection bars and the hollow pipes are attached.

Details of fixing device 3A will be described with reference to FIG. 19 to FIG. 25.

Figure 19:
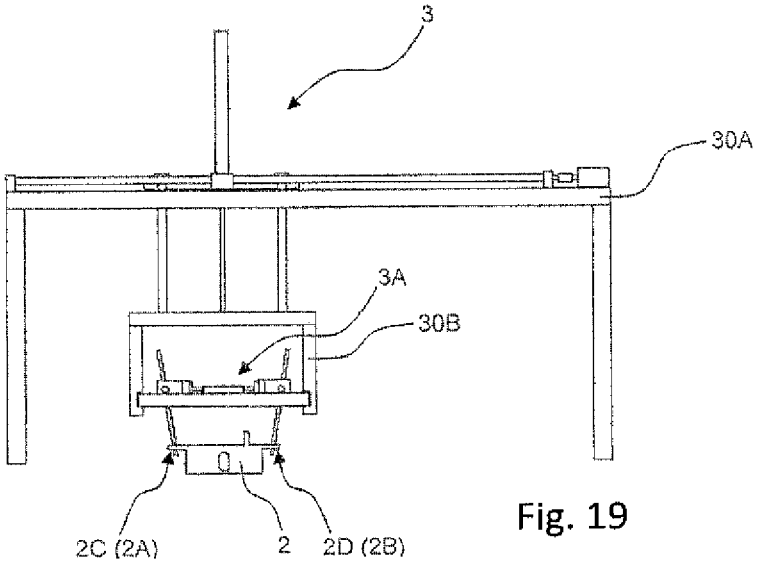
FIG. 19 is a front elevational view conceptually illustrating structures of the member-displacement mechanism and the fixing apparatus for a member to be plated of the plating apparatus according to the example shown in FIG. 18.
Figure 20:
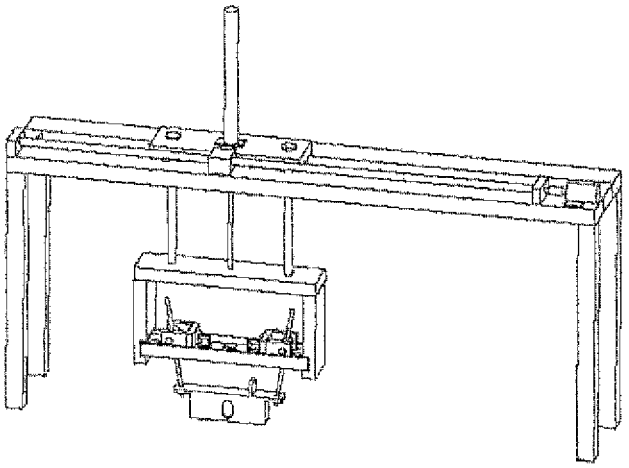
FIG. 20 is a perspective view conceptually illustrating the configuration of the fixing apparatus for a member to be plated shown in FIG. 19.
Figure 21:
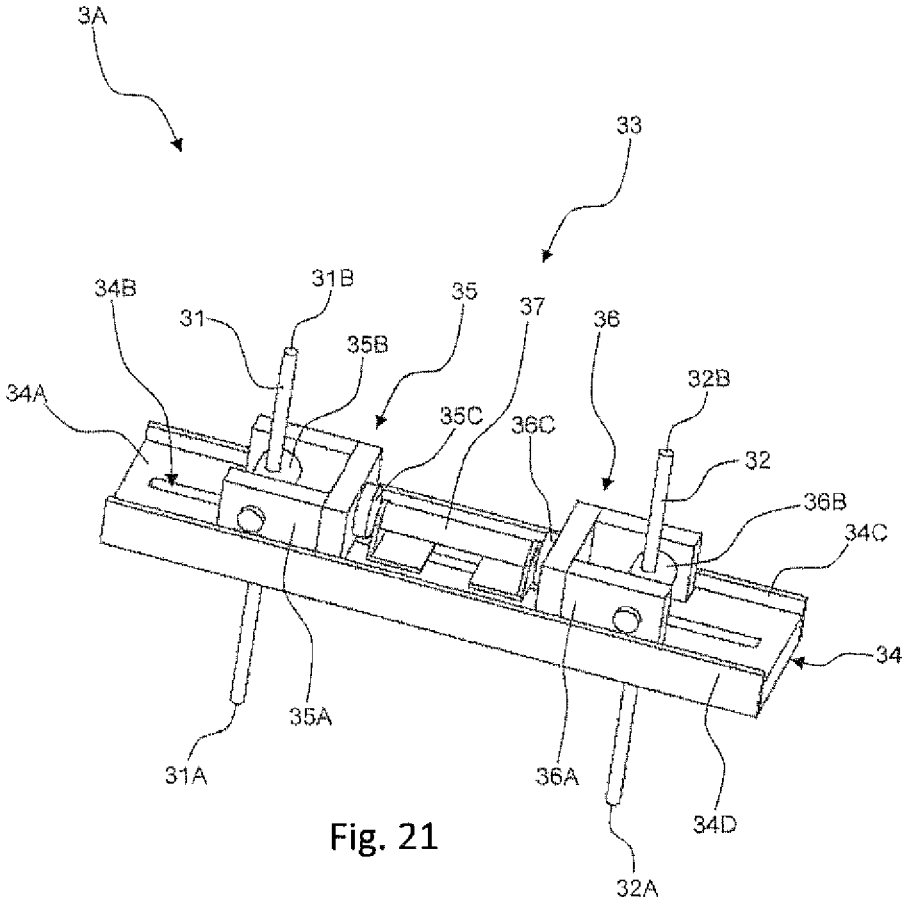
FIG. 21 is a perspective view conceptually illustrating a main part of the fixing apparatus for a member to be plated shown in FIG. 20.
Figure 22:
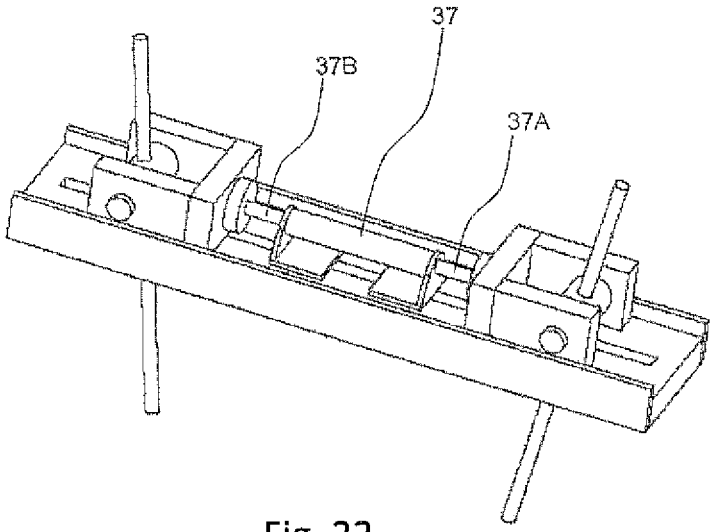
FIG. 22 is a perspective view conceptually illustrating a state where a rod-shaped body driving mechanism of the fixing apparatus for a member to be treated shown in FIG. 21 is operated to cause a first rod-shaped body and a second rod-shaped body to move in directions that one ends of these rod-shaped bodies depart from each other.
Figure 23:
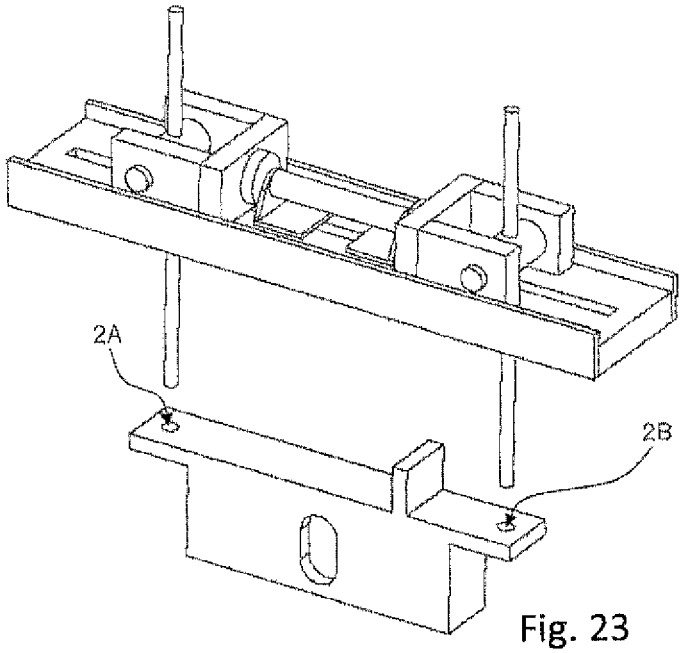
FIG. 23 is a perspective view conceptually illustrating an operation of the fixing apparatus for a member to be plated shown in FIG. 21 and represents a state where the member to be plated is located below the fixing apparatus.
Figure 24:
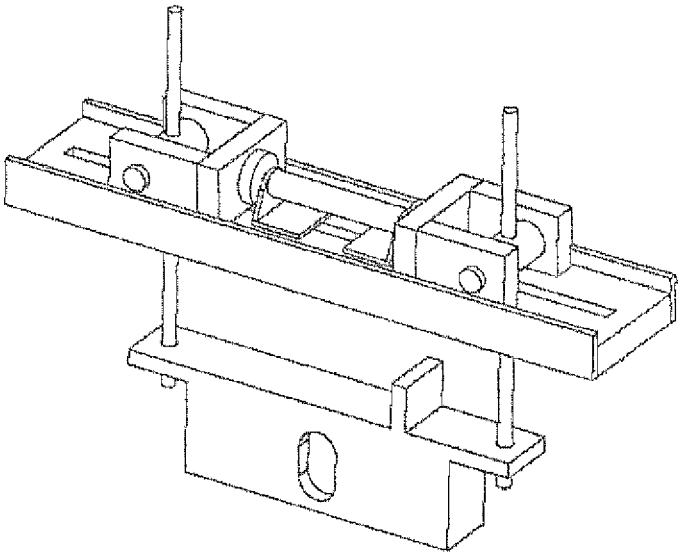
FIG. 24 is a perspective view conceptually illustrating an operation of the fixing apparatus for the member to be plated shown in FIG. 21 and represents a state where the fixing apparatus moves downward from the state shown in FIG. 23 so that the fixing apparatus and the member to be plated are proximal to each other and other ends of the first and second rod-shaped bodies are inserted into hollow portions of the member to be plated.
Figure 25:
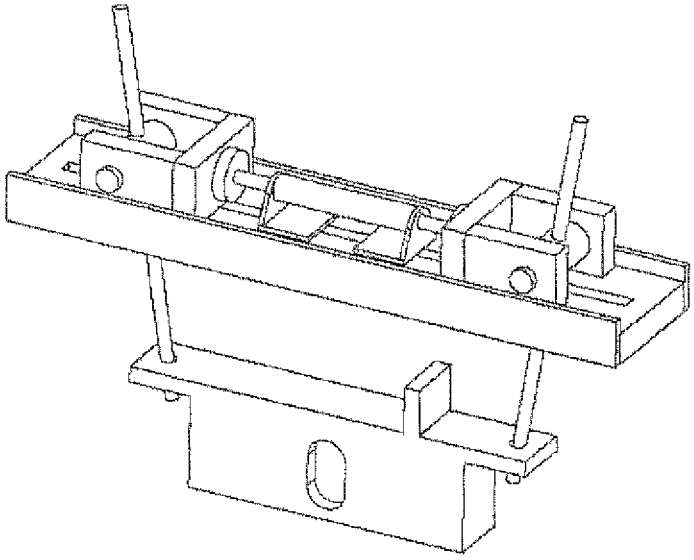
FIG. 25 is a perspective view conceptually illustrating an operation of the fixing apparatus for the member to be plated shown in FIG. 21 and represents a state where the rod-shaped body driving mechanism is operated from the state shown in FIG. 24 to move the first rod-shaped body and the second rod-shaped body in directions that the one ends of these rod-shaped bodies depart from each other and the member to be treated is held by the first and second rod-shaped bodies.

FIG. 19 is a front elevational view conceptually illustrating structures of the member-displacement mechanism and the fixing apparatus for a member to be plated shown in FIG. 18. FIG. 20 is a perspective view conceptually illustrating the configuration of the fixing apparatus for a member to be plated shown in FIG. 19. FIG. 21 is a perspective view conceptually illustrating a main part of the fixing apparatus for a member to be plated shown in FIG. 20. FIG. 22 is a perspective view conceptually illustrating a state where a rod-shaped body driving mechanism of the fixing apparatus for a member to be treated shown in FIG. 21 is operated to cause a first rod-shaped body and a second rod-shaped body to move in directions that one ends of these rod-shaped bodies depart from each other. FIG. 23 is a perspective view conceptually illustrating an operation of the fixing apparatus for a member to be plated shown in FIG. 21 and represents a state where the member to be plated is located below the fixing apparatus. FIG. 24 is a perspective view conceptually illustrating an operation of the fixing apparatus for the member to be plated shown in FIG. 21 and represents a state where the fixing apparatus moves downward from the state shown in FIG. 23 so that the fixing apparatus and the member to be plated are proximal to each other and other ends of the first and second rod-shaped bodies are inserted into hollow portions of the member to be plated. FIG. 25 is a perspective view conceptually illustrating an operation of the fixing apparatus for the member to be plated shown in FIG. 21 and represents a state where the rod-shaped body driving mechanism is operated from the state shown in FIG. 24 to move the first rod-shaped body and the second rod-shaped body in directions that the one ends of these rod-shaped bodies depart from each other and the member to be treated is held by the first and second rod-shaped bodies.

As shown in FIG. 19 and FIG. 20, the upper surface of a portal frame 30A is provided with a member-displacement mechanism 3 which comprises two linear movement mechanisms each using a ball screw driven by a stepping motor, among which the vertical linear movement mechanism has a lower end attached thereto with a portal member 30B which holds a fixing device 3A.

The fixing device 3A is a fixing device for fixing a member 2 to be plated which comprises two hollow portions 2A, 2B each having at least one aperture. The member 2 to be plated shown in FIG. 19 and FIG. 20 has two through-holes 2C, 2D each having center axis in the direction parallel to the vertical direction, and respective inner sides of these through-holes 2C, 2D define the above hollow portions 2A, 2B.

As shown in FIG. 21, the fixing device 3A comprises a first rod-shaped body 31 of which one end 31A is made capable of being inserted into the hollow portion 2A of the member 2 to be plated from the aperture thereof, i.e. from the upper side aperture of the through-hole, and a second rod-shaped body 32 of which one end 32A is made capable of being inserted into the hollow portion 2B of the member 2 to be plated from the aperture thereof, i.e. from the upper side aperture of the through-hole. The first rod-shaped body 31 and the second rod-shaped body 32 are provided for the purpose of directly fixing the member 2 by being pressed thereto, and one or more contact portions of at least one of them or preferably both of them to the member 2 in the hollow portions 2A, 2B act as electrical contact portions for the member 2. Therefore, at least one of the first rod-shaped body 31 and the second rod-shaped body 32 is formed of a conductive member, and preferably both are formed of conductive members.

The fixing device 3A comprises a rod-shaped body movably holding mechanism 33 which allows the first rod-shaped body 31 and the second rod-shaped body 32 to move in directions that their respective other ends 31B, 32B come close to each other or directions that they depart from each other and which holds the first rod-shaped body 31 and the second rod-shaped body 32 in a state where their other ends 31B, 32B are biased in directions that they come close to each other or directions that they depart from each other so that the first rod-shaped body 31 contacts with pressure to at least two positions inside the hollow portion 2A of the member 2 to be plated while the second rod-shaped body 32 contacts with pressure to at least two positions inside the hollow portion 2B of the member 2, thereby to hold the member 2.

The rod-shaped body movably holding mechanism 33 included in the fixing device 3A shown in FIG. 21 comprises: a guide member 34 having a slit 34B configured such that the first rod-shaped body 31 and the second rod-shaped body 32 are movable in a state of penetrating therethrough; a first sliding member 35 which holds the first rod-shaped body 31 in a pivotally movable manner and slides on the guide member 34; a second sliding member 36 which holds the second rod-shaped body 32 in a pivotally movable manner and slides on the guide member 34; and a rod-shaped body driving mechanism 37 having a driving mechanism which moves the first sliding member 35 and the second sliding member 36 in directions that they depart from each other on the guide member and holds a state where the other end 31B of the first rod-shaped body 31 and the other end 32B of the second rod-shaped body 32 are biased in directions that they depart from each other.

The guide member 34 comprises a planar substrate 34A having a rectangular shape in the planar view, and the slit 34B has its long axis parallel to that of a main surface of the substrate 34A and passes therethrough in the normal direction to the main surface. The width of this slit 34B is set such that the first rod-shaped body 31 and the second rod-shaped body 32 can be located to penetrate through the slit 34B and in this state they can stably slide thereon. In addition, one of main surfaces of the guide member 34 is provided with guide rails 34C, 34D protruding from both longer sides thereof.

The first sliding member 35 comprises: a sliding frame 35A which has a U-shaped planar view and is capable of sliding on one main surface of the substrate 34A of the guide member 34 in the longer side direction of the substrate 34A while being restricted by the guide rails 34C, 34D its movement in the shorter direction of the substrate 34A; a pivotal movement holding portion 35B which is held by the sliding frame 35A so as to allow the first rod-shaped body 31 to pivotally move around a pivotal axis parallel to the horizontal plane while holding the first rod-shaped body 31 at a predetermined position in the axial direction of the first rod-shaped body 31; and a contact portion 35C which is provided at an end proximal to the second sliding member 36 and is for being contacted with the rod-shaped body driving mechanism 37.

The second sliding member 36 comprises: a sliding frame 36A which has a U-shaped planar view and is capable of sliding on one main surface of the substrate 34A of the guide member 34 in the longer side direction of the substrate 34A while being restricted by the guide rails 34C, 34D its movement in the shorter direction of the substrate 34A; a pivotal movement holding portion 36B which is held by the sliding frame 36A so as to allow the second rod-shaped body 32 to pivotally move around a pivotal axis parallel to the horizontal plane while holding the second rod-shaped body 32 at a predetermined position in the axial direction of the second rod-shaped body 32; and a contact portion 36C which is provided at an end proximal to the first sliding member 35 and is for being contacted with the rod-shaped body driving mechanism 37.

The rod-shaped body driving mechanism 37 is fixed to one main surface of the substrate 34A between the first sliding member 35 and the second sliding member 36, and comprises pushing pins 37A, 37B, as shown in FIG. 22, which are provided at respective ends thereof in a direction parallel to the longer side direction of the substrate 34A and which can press the contact portions 35C, 36C in directions that the contact portions 35C, 36C are separated from each other. The pushing pins 37A, 37B are driven by compressed air in the present example.

The fixing device 3A according to the present embodiment operates as follows.

First, as shown in FIG. 23, the fixing device 3A is located above the member 2 to be plated so that the center axis of the through-hole 2C of the member 2 and the center axis of the first rod-shaped body 31 are substantially coaxially positioned, the center axis of the through-hole 2D of the member 2 and the center axis of the second rod-shaped body 32 are also substantially coaxially positioned, and a line in the horizontal plane connecting the hollow portion 2A (i.e. hollow portion of the through-hole 2C) of the member 2 and the hollow portion 2B (i.e. hollow portion of the through-hole 2D) of the member 2 is substantially parallel to the sliding direction of the first sliding member 35 and the second sliding member 36, i.e. substantially parallel to the long axis direction of the slit 34B. In order to achieve such a location, pushed-out amounts by the pushing pins 37A, 37B of the rod-shaped body driving mechanism 37 may be adjusted. The hole diameter of the through-hole 2C of the member 2 to be plated is larger than the rod diameter of the first rod-shaped body 31 and the hole diameter of the through-hole 2D of the member 2 is larger than the rod diameter of the second rod-shaped body 32, so the first rod-shaped body 31 is capable of being inserted into the through-hole 2C and the second rod-shaped body 32 is capable of being inserted into the through-hole 2D, respectively.

Thereafter, as shown in FIG. 24, the member-displacement mechanism 3 not shown is operated to move the fixing device 3A to be proximal to the member 2 thereby inserting the first rod-shaped body 31 and the second rod-shaped body 32 into the through-hole 2C and the through-hole 2D, respectively. In FIG. 24, both the one ends 31A and 32A of the first rod-shaped body 31 and the second rod-shaped body 32 entirely penetrate the through-holes 2C and 2D, respectively, thus extending outside the member 2 to be plated. Alternatively, these ends 31A, 32A may remain in the through-holes 2C, 2D.

Subsequently, as shown in FIG. 25, the pushing pins 37A, 37B of the rod-shaped body driving mechanism 37 are caused to protrude so as to depart from each other. As a result, the pushing pin 37A pushes the contact portion 35C of the first sliding member 35 and the pushing pin 37B pushes the contact portion 36C of the second sliding member 36, so that the first sliding member 35 and the second sliding member 36 slide on the guide member 34 so as to depart from each other.

The above operation causes the first rod-shaped body 31 and the second rod-shaped body 32 to move so that the respective other ends 31B, 32B depart from each other. More specifically, the first rod-shaped body 31 moves in the direction of departing from the rod-shaped body driving mechanism 37 along the long axis direction of the slit 34B, but the movement amount thereof is restricted because the one end 31A of the first rod-shaped body 31 is present in the hollow portion 2A (i.e. hollow portion of the through-hole 2C) of the member 2 to be plated. This forces the first rod-shaped body 31 to pivotally move around the pivotal axis provided by the pivotal movement holding portion 35B so that the other end 31B of the first rod-shaped body 31 departs from the other end 32B of the second rod-shaped body 32. On the other hand, the second rod-shaped body 32 is caused to pivotally move, like in the case of the first rod-shaped body 31, around the pivotal axis provided by the pivotal movement holding portion 36B so that the other end 32B of the second rod-shaped body 32 departs from the other end 31B of the first rod-shaped body 31.

Consequently, the first rod-shaped body 31 at the side of its one end 31A contacts with the member 2 to be plated at the aperture of the through-hole 2C facing the fixing device 3A and at the inside of the through-hole 2C, i.e. two positions inside the hollow portion 2A. In this situation, the part of the first rod-shaped body 31 fixed to the pivotal movement holding portion 35B acts as the point of effort, the part of the member 2 contacting with the aperture of the through-hole 2C facing the fixing device 3A acts as the fulcrum, and the part of the member 2 contacting with the inside of the through-hole 2C (hollow portion 2A) acts as the point of load, thus the first rod-shaped body 31 is pressed to the member 2 at the hollow portion 2A.

Like the above, the second rod-shaped body 32 at the side of its one end 32A contacts with the member 2 to be plated at the aperture of the through-hole 2D facing the fixing device 3A and at the inside of the through-hole 2D, i.e. two positions inside the hollow portion 2B. In this situation, the part of the second rod-shaped body 32 fixed to the pivotal movement holding portion 36B acts as the point of effort, the part of the member 2 contacting with the aperture of the through-hole 2D facing the fixing device 3A acts as the fulcrum, and the part of the member 2 contacting with the inside of the through-hole 2D (hollow portion 2B) acts as the point of load, thus the second rod-shaped body 32 is pressed to the member 2 at the hollow portion 2B.

The rod-shaped body driving mechanism 37 holds this state, and more specifically the pushing pins 37A, 37B maintain the pressing by the contact portions 35C, 36C, thereby fixing the member 2 to the fixing device 3A via the first rod-shaped body 31 and the second rod-shaped body 32.

When the fixing of the member 2 to the fixing device 3A is released, the pressing of the contact portions 35C, 36C by the pushing pins 37A, 37B may be finished so that parts of the pushing pins 37A, 37B can return into the rod-shaped body driving mechanism 37. As a result, the application of pressure to the part of the pivotal movement holding portion 35B as the point of effort to hold the first rod-shaped body 31 is released, and the application of pressure to the contact portion in the hollow portion 2A with the first rod-shaped body 31 as the point of load is thereby also released. In a similar manner, the application of pressure to the part of the pivotal movement holding portion 36B as the point of effort to hold the second rod-shaped body 32 is released, and the application of pressure to the contact portion in the hollow portion 2B with the second rod-shaped body 32 as the point of load is thereby also released. In such a way, the member 2 becomes releasable from the fixing device 3A. Specifically, the fixing device 3A may be moved upward so that the first rod-shaped body 31 and the second rod-shaped body 32 are extracted from the through-holes 2C, 2D of the member 2.

It should be appreciated that the embodiments heretofore explained are described to facilitate understanding of the present invention and are not described to limit the present invention. Therefore, it is intended that the elements disclosed in the above embodiments include all design changes and equivalents to fall within the technical scope of the present invention.

EXPLANATION OF NUMERAL REFERENCES

100 . . . plating apparatus
1 . . . plating bath
1A; partition plate for overflowing
2 . . . member to be plated
3 . . . member-displacement mechanism
3A . . . fixing device
3B . . . vertical direction linear movement sliding axis
3C . . . horizontal direction linear movement sliding axis
3D . . . sliding and holding device
4A . . . fixed anode
4B . . . movable anode
4C . . . NAU anode
4D . . . through-hole of NAU anode
5 . . . anode-displacement mechanism
5A . . . vertical direction linear movement sliding axis
5B . . . horizontal direction linear movement sliding axis
5C . . . sliding and holding device
6 . . . circulation mechanism
6A . . . plating solution-suctioning portion
6B . . . outward pipe
6C . . . pump
6D . . . return pipe
6E . . . first return pipe
6E . . . fixed plating solution-ejecting portion
6G . . . first flow volume adjusting valve
6H . . . second return pipe
6I . . . second flow volume adjusting valve
6J . . . movable plating solution-ejecting portion
6K . . . ejecting hole
6L . . . third return pipe
6M . . . NAU ejecting portion
6N . . . ejecting hole
6O . . . third flow volume adjusting valve
7 . . . ejecting portion-displacement mechanism
7A . . . vertical direction linear movement sliding axis
7B . . . horizontal direction linear movement sliding axis
7C . . . sliding and holding device
8 . . . nozzle-anode unit (NAU)
9 . . . NAU-displacement mechanism
9A . . . vertical direction linear movement sliding axis
9B . . . horizontal direction linear movement sliding axis
9C . . . sliding and holding device
10 . . . plating electric power supply
10A . . . anode terminal
10B . . . cathode terminal
11A . . . wiring for fixed anode
11B . . . wiring for movable anode
11C . . . wiring for insoluble anode of NAU
11D . . . wiring for member to be plated
12A . . . measurement instrument for wiring to fixed anode
12B . . . measurement instrument for wiring to movable anode
12C . . . measurement instrument for wiring to anode of NAU
13 . . . controller
13A . . . signal input unit
13B . . . electric-output controller
13C . . . position controller
13D . . . circulation controller
14A . . . pump driver
14B . . . first flow volume adjuster
14C . . . second flow volume adjuster
14D . . . third flow volume adjuster
41, 42, 43, 44 . . . movable anode
41A, 42A, 43A, 44A . . . connection bar for movable anode
81, 82, 83, 84 . . . tubular NAU
81A . . . plating solution-ejecting portion
81B . . . ejecting hole
81C . . . insoluble anode
81D . . . through-hole of insoluble anode
81E . . . first end of insoluble anode
81F . . . tubular portion of insoluble anode
81G . . . second end of insoluble anode
81H . . . planar member of insoluble anode
81I . . . connection bar of insoluble anode
81J . . . through-hole of plating solution-ejecting portion
81K . . . hollow pipe
85, 86 . . . box NAU
85A, 86A . . . insoluble anode of box NAU
85B . . . plating solution-ejecting portion
85C . . . through-holes of insoluble anode
85D . . . connection bar of insoluble anode
85E . . . ejecting hole
85F . . . hollow pipe
51 . . . anode-displacement mechanism
91 . . . NAU-displacement mechanism
30A . . . portal frame
30B . . . portal member
31 . . . first rod-shaped body
31A . . . one end of first rod-shaped body
31B . . . other end of first rod-shaped body
32 . . . second rod-shaped body
32A . . . one end of second rod-shaped body
32B . . . other end of second rod-shaped body
2A, 2B . . . hollow portion of member to be plated
33 . . . rod-shaped body movably holding mechanism
34 . . . guide member
34A . . . substrate of guide member
34B . . . slit
34C, 34D . . . guide rail
35 . . . first sliding member
35A . . . sliding frame
35B . . . pivotal movement holding portion
35C . . . contact portion
36 . . . second sliding member
36A . . . sliding frame
36B . . . pivotal movement holding portion
36C . . . contact portion
37 . . . rod-shaped body driving mechanism
37A, 37B . . . pushing pin

The invention claimed is:

1. A plating apparatus comprising:

a plating bath;

an insoluble anode located in the plating bath;

a plating electric power supply being configured to apply a voltage between the insoluble anode and a member to be plated;

an anode-displacement mechanism being configured to move the insoluble anode in the plating bath and to hold the insoluble anode at a predetermined position in the plating bath;

a controller having an anode-position controller being configured to generate a control signal for controlling an action of the anode-displacement mechanism and to output the control signal to the anode-displacement mechanism;

a measurement instrument being configured to measure at least one of a current flowing through the insoluble anode and an electric potential of the insoluble anode with respect to the member to be plated while a voltage is applied from the plating electric power supply;

a circulation mechanism for circulating a plating solution in the plating bath, the circulation mechanism having a plating solution-suctioning portion, a pump, and a plating solution-ejecting portion;

a circulation controller contained in the controller, the circulation controller being configured to generate a control signal for controlling an action of the circulation mechanism and to output the control signal to the circulation mechanism;

an ejecting portion-displacement mechanism being configured to move the ejecting portion in the plating bath and to hold the ejecting portion at a predetermined position in the plating bath; and an ejecting portion-position controller contained in the controller, the ejecting portion-position controller being configured to generate a control signal for controlling an action of the ejecting portion-displacement mechanism and to output the control signal to the ejecting portion-displacement mechanism, wherein the ejecting portion-position controller is configured to generate the control signal for controlling an action of the ejecting portion-displacement mechanism based on a result measured by the measurement instrument, wherein the circulation mechanism has an ejecting-volume adjusting mechanism being configured to adjust a plating solution ejecting-volume ejected from the plating solution-ejecting portion, and wherein the circulation controller comprises an ejecting-volume controller being configured to generate a control signal for controlling an action of the ejecting-volume adjusting mechanism based on a result measured by the measurement instrument and to output the control signal to the ejecting-volume adjusting mechanism.

2. The plating apparatus according to claim 1, wherein the controller comprises an electric-output controller being capable of generating a control signal for controlling at least one of a current and a voltage applied to the insoluble anode based on a result measured by the measurement instrument and of outputting the control signal to the plating electric power supply.

3. The plating apparatus according to claim 1, wherein the anode-position controller is capable of generating a control signal for controlling an action of the anode-displacement mechanism based on a result measured by the measurement instrument and of outputting the control signal to the anode-displacement mechanism.

4. The plating apparatus according to claim 1, the apparatus further comprising:

a circulation mechanism for circulating a plating solution in the plating bath, the circulation mechanism having a plating solution-suctioning portion, a pump, and a plating solution-ejecting portion;

a circulation controller contained in the controller, the circulation controller being capable of generating a control signal for controlling an action of the circulation mechanism and of outputting the control signal to the circulation mechanism;

an ejecting portion-displacement mechanism being capable of moving the ejecting portion in the plating bath and of holding the ejecting portion at a predetermined position in the plating bath; and an ejecting portion-position controller contained in the controller, the ejecting portion-position controller being capable of generating a control signal for controlling an action of the ejecting portion-displacement mechanism and of outputting the control signal to the ejecting portion-displacement mechanism.

5. The plating apparatus according to claim 4, wherein the circulation mechanism has an ejecting-volume adjusting mechanism being capable of adjusting a plating solution ejecting-volume ejected from the plating solution-ejecting portion, and the circulation controller comprises an ejecting-volume controller being capable of generating a control signal for controlling an action of the ejecting-volume adjusting mechanism and of outputting the control signal to the ejecting-volume adjusting mechanism.

6. The plating apparatus according to claim 1, the apparatus further comprising:

a member-displacement mechanism being capable of moving the member to be plated and of holding the member to be plated at a position in which at least a part of the member to be plated is located in the plating bath; and a member-position controller contained in the controller, the member-position controller being capable of generating a control signal for controlling an action of the member-displacement mechanism and of outputting the control signal to the member-displacement mechanism.

7. The plating apparatus according to claim 6, wherein the member-position controller is capable of outputting the control signal for controlling an action of the member-displacement mechanism while a voltage is applied between the insoluble anode and the member to be plated from the plating electric power supply.

8. The plating apparatus according to claim 4, wherein the insoluble anode is such that its relative position to the plating solution-ejecting portion is managed, at least a part of the insoluble anode is located at a position from which an ejecting hole of the plating solution-ejecting portion is in view, the ejecting portion-displacement mechanism and the anode-displacement mechanism are integrated, and the ejecting portion-position controller and the anode-position controller are integrated.

9. The plating apparatus according to claim 8, wherein the insoluble anode is such that the part of the insoluble anode located at the position from which the ejecting hole of the plating solution-ejecting portion is in view has a shape of a guide being capable of guiding a plating solution ejected from the plating solution-ejecting portion to a predetermined direction.

10. The plating apparatus according to claim 8, wherein the insoluble anode is such that the part of the insoluble anode located at the position from which the ejecting hole of the plating solution-ejecting portion is in view has a shape of a structure formed of a planar member having a through-hole or a structure obtained by fabricating a planar member.

11. The plating apparatus according to claim 6, wherein, upon a condition that the member-position controller has driven the member-displacement mechanism so that at least a part of the member to be plated is immersed in a plating solution, at least one of plural position controllers included in the controller drives at least one of displacement mechanisms, which is other than the member-displacement mechanism and is controlled by the at least one position controller, so that a component that is capable of moving in the plating bath by the at least one displacement mechanism moves in a direction proximal to the member to be plated.

12. The plating apparatus according to claim 11, wherein, upon a condition that at least one of plural position controllers included in the controller has driven at least one of displacement mechanisms, which is other than the member-displacement mechanism and is controlled by the at least one position controller, so that a component that is capable of moving in the plating bath by the at least one displacement mechanism moves in a direction distal from the member to be plated, the member-position controller drives the member-displacement mechanism so that the member to be plated is taken out of the plating solution.

* * * * *